US011059631B1

(12) United States Patent
Brunner et al.

(10) Patent No.: US 11,059,631 B1
(45) Date of Patent: Jul. 13, 2021

(54) UTILITY ASSEMBLY AND CONNECTIVITY SYSTEM THEREFORE

(71) Applicant: Keter Plastic Ltd., Herzliya (IL)

(72) Inventors: Yaron Brunner, Kibbutz Gvat (IL); Ayala Vardi Bougay, Kefar Veradim (IL); Oren Hetzroni, Herut (IL)

(73) Assignee: KETER PLASTIC LTD., Herzliya (IL)

( * ) Notice: Subject to any disclaimer, the term of this patent is extended or adjusted under 35 U.S.C. 154(b) by 0 days.

(21) Appl. No.: 16/818,562

(22) Filed: Mar. 13, 2020

(30) Foreign Application Priority Data

Jan. 12, 2020 (IL) ..... 271995

(51) Int. Cl.
*B65D 45/24* (2006.01)
*B65D 21/02* (2006.01)

(52) U.S. Cl.
CPC ..... *B65D 45/24* (2013.01); *B65D 21/0219* (2013.01)

(58) Field of Classification Search
CPC ..... B65D 21/0212; B65D 21/0217; B65D 21/0219; B65D 21/023; B65D 21/0215; B65D 21/0226; B65D 21/06; B65D 21/062; B65D 21/066
See application file for complete search history.

(56) References Cited

U.S. PATENT DOCUMENTS

| | | | | |
|---|---|---|---|---|
| 2,409,748 | A * | 10/1946 | Folst | B65D 21/0212 206/512 |
| 4,423,813 | A * | 1/1984 | Kreeger | B65D 21/062 206/506 |
| 6,983,946 | B2 * | 1/2006 | Sullivan | B62B 1/002 206/511 |
| 2008/0035655 | A1 * | 2/2008 | Baumgartner | A01K 5/01 220/751 |
| 2017/0121056 | A1 | 5/2017 | Wang | |
| 2018/0161975 | A1 | 6/2018 | Brunner | |
| 2018/0220758 | A1 | 8/2018 | Burchia | |

FOREIGN PATENT DOCUMENTS

| | | |
|---|---|---|
| DE | 10 2013 202 869 A1 | 9/2013 |
| EP | 3 492 226 A1 | 6/2019 |
| WO | 2017/098513 A1 | 6/2017 |
| WO | 2019/020379 A1 | 1/2019 |
| WO | 2020/003302 A1 | 1/2020 |

* cited by examiner

*Primary Examiner* — Andrew T Kirsch
(74) *Attorney, Agent, or Firm* — Vorys, Sater, Seymour and Pease LLP; William L. Klima

(57) ABSTRACT

Provided is a connectivity system for a utility module, including one or both of: a rigid base portion with at least one engaging tab projecting at a first edge portion of the rigid base portion, and at least one locking receptacle disposed at a second edge portion of the rigid base portion; and a rigid mounting platform comprising an upwardly extending perimetric rim defining a utility module arresting space, the rim being configured with at least one tab arresting receptacle at a first location, and at least one locking latch at a second location.

27 Claims, 22 Drawing Sheets

UTILITY ASSEMBLY AND CONNECTIVITY SYSTEM THEREFORE

TECHNOLOGICAL FIELD

The present disclosure concerns a utility assembly and a connectivity system configured to facilitate detachable attaching of utility modules to one another.

The term 'utility module' is used hereinafter in its broad meaning and is meant to denote a variety of articles such as, storage containers, travel luggage, tool boxes, organizers, compacted work benches, cable storage, tools (e.g. hand tools, power generators and power sources), communication modules, carrying platforms, racks, locomotion platforms, etc., of any shape and size, and wherein any utility module can be detachably attached to other one or more utility modules.

BACKGROUND ART

References considered to be relevant as background to the presently disclosed subject matter are listed below:

US2018/220758

WO19/020379

Acknowledgement of the above references herein is not to be inferred as meaning that these are in any way relevant to the patentability of the presently disclosed subject matter.

BACKGROUND

US2018/220758 discloses a suitcase for stacking with a further suitcase, comprising a contact surface for stacking the further suitcase, at least one coupling part which can be brought together with a matching coupling part of the further suitcase to form a plug-in connection, wherein the coupling part is aligned such that the plug-in connection to the matching coupling part is formed by displacing the further suitcase along the contact surface. At least one locking element is provided to secure the plug-in connection against being released, wherein the locking element can be displaced from an initial position to an intermediate or end position, and in the initial position is in a receiving region for the additional suitcase, which is used when placing the further suitcase on the contact surface. The document further relates to an arrangement comprising at least two suitcases stacked one above the other and a method for stacking at least two suitcases.

WO19/020379 relates to a storage box for small parts, in particular screws, comprising a base and at least two lateral walls which extend from the base and lie opposite each other. The base and/or the lateral walls have at least one support flange for stacking multiple identical storage boxes. When two storage boxes are stacked, the lower end region of the first lateral wall of the upper storage box is parallel to the upper end region of the first lateral wall of the lower storage box, and the lower end region of the second lateral wall of the upper storage box is parallel to the upper end region of the second lateral wall of the lower storage box, wherein at least one of the lateral walls is equipped with at least one bar, which can be moved between a release position and a locking position and which secures together two storage boxes stacked on top of each other in the locking position and releases same in the release position.

GENERAL DESCRIPTION

A according to a first aspect of the disclosure there is provided a utility module connectivity system comprising:

a first utility module configured with at least a rigid base portion with at least one engaging tab projecting at a first edge portion of the rigid base portion, and at least one locking receptacle disposed at a second edge portion of the rigid base portion;

said at least one engaging tab and at least one locking receptacle extend substantially parallel to a surface of the rigid base portion, are disposed at opposite sides thereof, and face at an opposite sense;

a second utility module comprising a rigid mounting platform defining a utility module arresting space and configured with at least one tab arresting receptacle at a first location, and at least one locking latch at a second location; said at least one locking latch displaceable between a locked position wherein said at least one locking latch projects into said utility module arresting space and is engageable with a locking receptacle of the first utility module, and an unlocked position wherein said at least one locking latch is retracted from said utility module arresting space;

and wherein the rigid base portion of the first utility module is configured for at least partially engaging the utility module arresting space of the rigid mounting platform.

According to a second aspect of the present disclosure there is disclosed a utility module system comprising two or more utility modules configured with a connectivity system for detachably coupling a utility module to another utility module, the connectivity system comprising:

a first utility module configured with at least a rigid base portion with at least one engaging tab projecting at a first edge portion of the rigid base portion, and at least one locking receptacle disposed at the rigid base portion;

said at least one engaging tab and at least one locking receptacle extend substantially parallel to a surface of the rigid base portion, are disposed at opposite sides thereof, and face at an opposite sense;

a second utility module comprising a rigid mounting platform defining a utility module arresting space and configured with at least one tab arresting receptacle at a first location, and at least one locking latch at a second location; said at least one locking latch displaceable between a locked position wherein said at least one locking latch projects into said utility module arresting space and is engageable with a locking receptacle of the first utility module, and an unlocked position wherein said at least one locking latch is retracted from said utility module arresting space;

and wherein the rigid base portion of the first utility module is configured for at least partially engaging the utility module arresting space of the rigid mounting platform.

The arrangement is such that the rigid base portion of a first utility module can be applied over the rigid mounting platform of a second utility module, such that the rigid base portion at least partially bears over at least a portion of the rigid mounting platform, and wherein the first utility module can be detachably articulated to the second utility module by arresting the at least one engaging tab with a corresponding at least one tab arresting receptacle, and displacing the at least one locking latch into the locked position, such that the at least one locking latch arrests within corresponding at least one locking receptacle.

A utility module according to the disclosure can be configured with both features of a connectivity system, comprising:

at least a rigid base portion with at least one engaging tab projecting at a first edge portion of the rigid base portion, and at least one locking receptacle disposed at a second edge portion of the rigid base portion; said at least one engaging tab and at least one locking receptacle extend substantially parallel to a surface of the rigid base portion, are disposed at opposite sides thereof, and face at an opposite sense;

a rigid mounting platform defining a utility module arresting space and configured with at least one tab arresting receptacle at a first location, and at least one locking latch at a second location; said at least one locking latch displaceable between a locked position wherein said at least one locking latch projects into said utility module arresting space and is engageable with a locking receptacle of a first utility module, and an unlocked position wherein said at least one locking latch is retracted from said utility module arresting space;

and wherein the rigid base portion is configured for at least partially engaging the utility module arresting space of the rigid mounting platform.

A utility module connectivity system is also provided, wherein the utility module comprises one or both of:

a rigid base portion with at least one engaging tab projecting at a first edge portion of the rigid base portion, and at least one locking receptacle disposed at a second edge portion of the rigid base portion, said at least one engaging tab and at least one locking receptacle extend substantially parallel to a surface of the rigid base portion, are disposed at opposite sides thereof, and face at an opposite sense; and a rigid mounting platform defining a utility module arresting space and configured with at least one tab arresting receptacle at a first location, and at least one locking latch at a second location; said at least one locking latch displaceable between a locked position wherein said at least one locking latch projects into said utility module arresting space and is engageable with a locking receptacle, and an unlocked position wherein said at least one locking latch is retracted from said utility module arresting space.

The rigid base portion of the first utility module can be configured for at least partially engaging the utility module arresting space of the rigid mounting platform or the rigid base portion of the first utility module is configured for at least partially bearing over at least a portion of the rigid mounting platform.

Thus, according to the present disclosure, a utility module can be configured with either or both connectivity features, namely those facilitating connecting the specific utility module to an other utility module, or those facilitating articulating said other utility module to the specific utility module.

According to one particular example, the at least one engaging tab and the at least one locking latch are disposed at opposite sides of the first utility module, where at a most particular embodiment, the at least one engaging tab is disposed at a rear side of the first utility module and the at least one locking latch is disposed at a front side of the first utility module.

The terms 'front side' and 'rear side' respectively, refer to any two oppositely disposed sides of a utility module, and can also be refereed to as two opposite side walls of the utility module.

According to an aspect of the disclosure, a first utility module is configured with a rigid base plate configured with an upright portion extending at a rear side, said upright portion comprising at least one rigid engaging tab laterally projecting therefrom, and at least one locking receptacle disposed at a front wall of the a rigid base plate, said at least one engaging tab is engageable with corresponding at least one tab arresting receptacle disposed in register at an upwardly extending rear rim of a second utility module, and said at least one locking receptacle is configured for arresting engagement with a corresponding at least one locking latch at a front rim portion of the second utility module.

Any one or more of the following features, designs and configurations can be applied to any of the aspects of the present disclosure, solely or in various combinations thereof:

- the at least one engaging tab and at least one locking receptacle can extend substantially parallel to one another, coaxial or offset;
- the at least one tab receptacle and at least one locking latch can extend substantially parallel to one another, coaxial or offset;
- the at least one tab receptacle and at least one locking latch can extend substantially normal to one another;
- the locking latch can be axially (slidingly) displaceable between its respective locked position and unlocked position;
- the locking latch can be pivotally displaceable between its respective locked position and unlocked position;
- the locking latch can be rotationally displaceable between its respective locked position and unlocked position;
- the locking latch can be manually displaceable at least between its unlocked position and locked position;
- the locking latch can be configured with a tapering engaging surface, whereby applying a force vector over said engaging surface results in retraction displacement of the locking latch. Such force can be applied, for example, by introducing a first utility module into place readily for articulation with the second utility module, at the event that the locking latch is at the locked position;
- the one or more locking latch can be biased into the locked position;
- the locking latch can be configured with a gripping portion for manipulating between the respective locked position and unlocked position, said gripping portion extending exterior to said utility module arresting space;
- the second utility module can be configured with an upwardly extending perimetric rim, at least partially bordering the rigid mounting platform, wherein the utility module arresting space resides within the boundaries of the rim;
- the rigid base portion of the first utility module can be configured for at least partially nesting within the perimetric rim of the second utility module;
- at a locked position of the locking latch, the gripping portion can be received within a cutout portion at an exterior face of the perimetric rim;
- at least portions of an inner wall of the perimetric rim can be outwardly slanted, serving as a positioning aid in placing the rigid base portion of first utility module in register over the rigid mounting platform of the second utility module;
- slanted portions of the inner wall of the perimetric rim can be wall portions not configured with a locking latch or a tab arresting receptacle;
- the at least one tab arresting receptacle can be configured as an opening at the perimetric rim, said opening facing an inside surface of the perimetric rim;
- the opening of the at least one tab arresting receptacle can be a through going aperture at the perimetric rim;
- a bottom surface of the at least one tab arresting receptacle can be flush with a bottom surface of the module arresting space at the rigid mounting platform;

a bottom surface of the engaging tab can be chamfered to facilitate easy insertion into the corresponding tab arresting receptacle;

a bottom surface of the at least one locking latch can be displaceable coplanar with the bottom surface of the at least one tab arresting receptacle;

a bottom surface of the at least one locking latch can be displaceable at a plane parallel with a plane of the bottom surface of the at least one tab arresting receptacle;

the rigid mounting platform can be a flat surface;

the rigid mounting platform can be configured with depressions extending in direction between the at least one tab arresting receptacle and the at least one locking latch;

the depressions can be continuous groove-like depressions, or intermitted depressions;

the at least one locking latch can be spring biased into the locked position;

the at least one locking latch can be displaceable between a distinct locked position and a distinct unlocked position, whereby the locking latch is prevented from spontaneous displacing between its respective positions by a snapping mechanism;

the engaging tab is displaceable into engagement within the tab arresting receptacle along an axis of the tab arresting receptacle, said axis defining a connectivity path, namely a path of insertion;

a bottom face of the rigid base portion can be configured with one or more ridges extending from a bottom surface thereof, in direction between the first edge portion and the second edge portion;

the one or more ridges at a bottom face of the rigid base portion can be continuous or intermitted;

the one or more ridges at a bottom face of the rigid base portion can be configured for at least partial nesting within corresponding depressions of the rigid mounting platform;

the first edge portion of the rigid base portion of the first utility module can be a wall portion substantially normally disposed with respect to a bottom surface of the rigid base portion;

side walls of the rigid base portion of the first utility module can be inwardly inclined towards a bottom surface thereof, configured for easy positioning over a rigid mounting platform of a second utility module;

a second edge portion of the rigid base portion of the first utility module can be inwardly inclined towards a bottom surface thereof, configured for easy positioning over a rigid mounting platform of a second utility module a foot print of the rigid base portion of the first utility module can correspond with a footprint of the a rigid mounting platform of the second utility module, or the footprint of the rigid base portion can be greater or smaller than the footprint of the rigid mounting platform;

the second utility module can be a stand alone mounting arrangement configured for articulating thereto a first utility module. For example, the rigid mounting platform can be articulated to, or it can be an integral part of a wall, a cabinet, a hand truck, secured to a bed of a truck, etc.;

the second utility module can be a stand alone mounting arrangement configured for articulating thereto a first utility module, said second utility module being part of a dolly;

the second utility module can be a container, wherein the rigid mounting platform is a configured as top surface of a lid of the container;

the rigid mounting platform can be a solid surface, or it can be a plane defining the module arresting space;

the second utility module can be an open-top container, e.g. a bucket type container, wherein the at an articulated position, the rigid base portion of the first utility module can be at least partially nested within the perimetric rim of the second utility module, thus closing at least a portion of the open-top container;

at an articulated position, the base plate of a first utility module can be disposed substantially parallel with a plane of the module arresting space of the second utility module.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
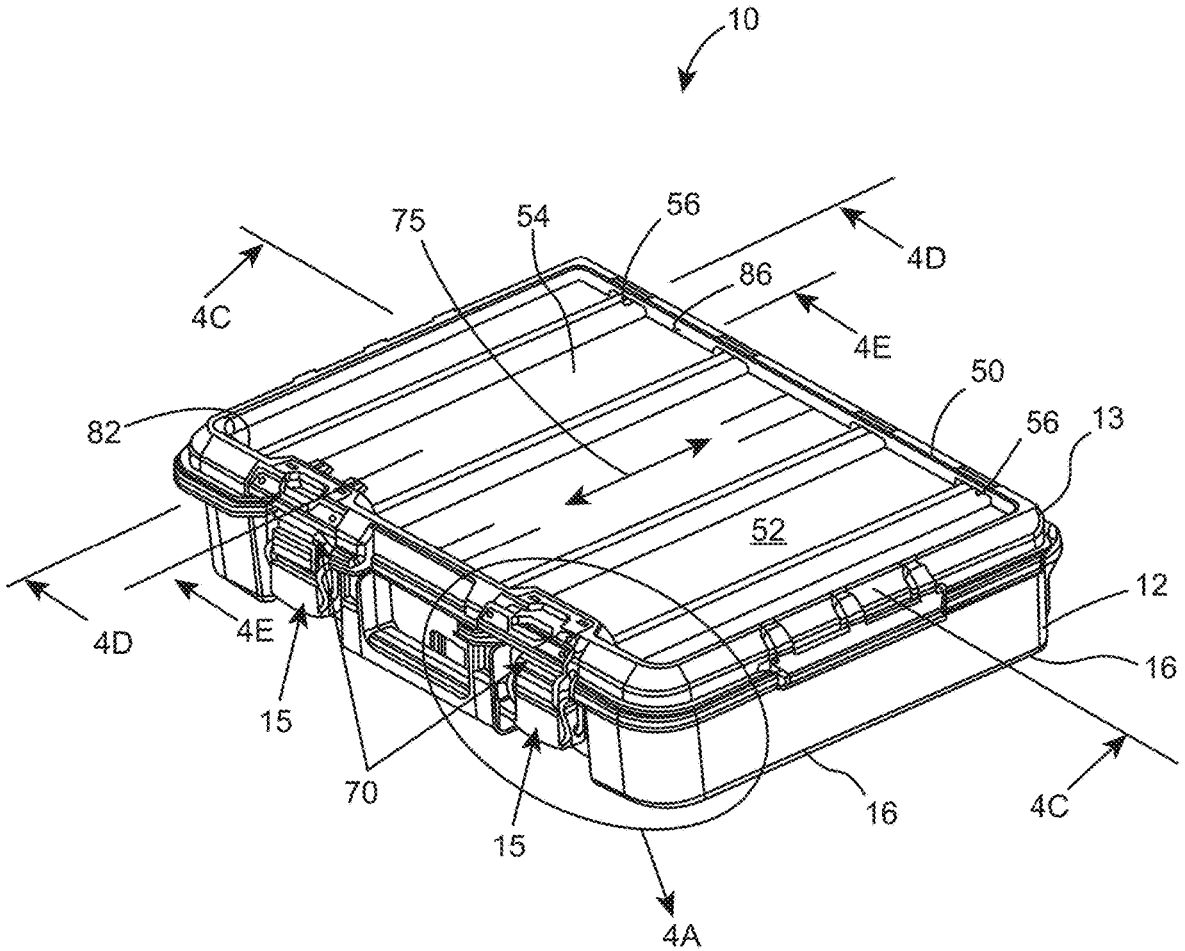
FIG. 1 is a front, top perspective view of a utility module according to the present disclosure, being a container, comprising two locking latches of which one is illustrated at a locked position and the other at the unlocked position.
Figure 2:
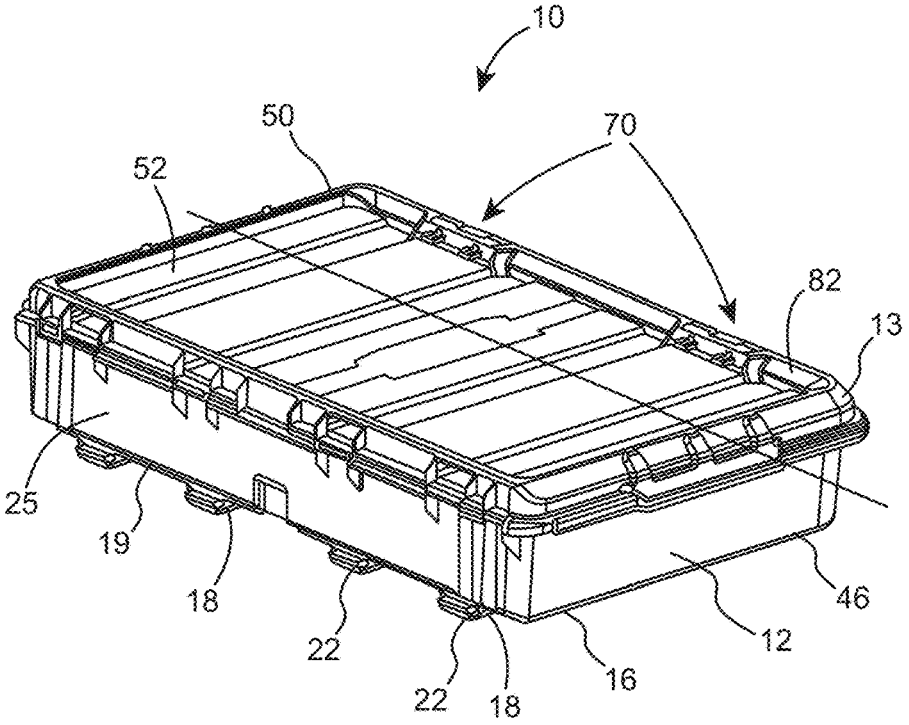
FIG. 2 is a back, top perspective view of the container of FIG. 1.
Figure 3:
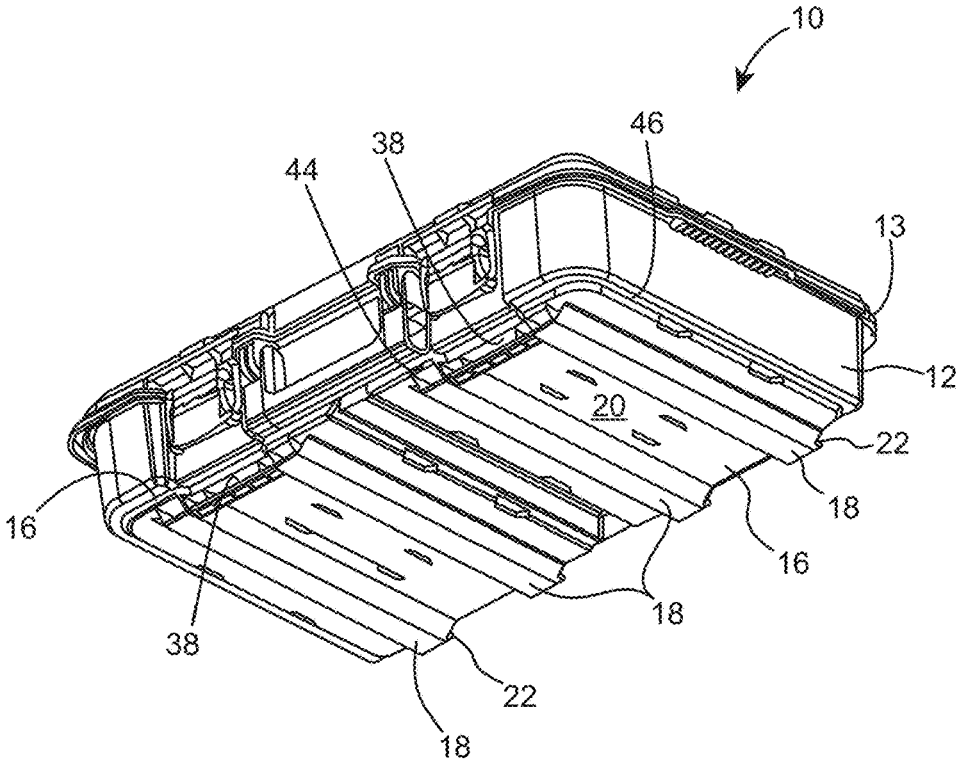
FIG. 3 a front, bottom, perspective view of the container of FIG. 1.
Figure 4B:
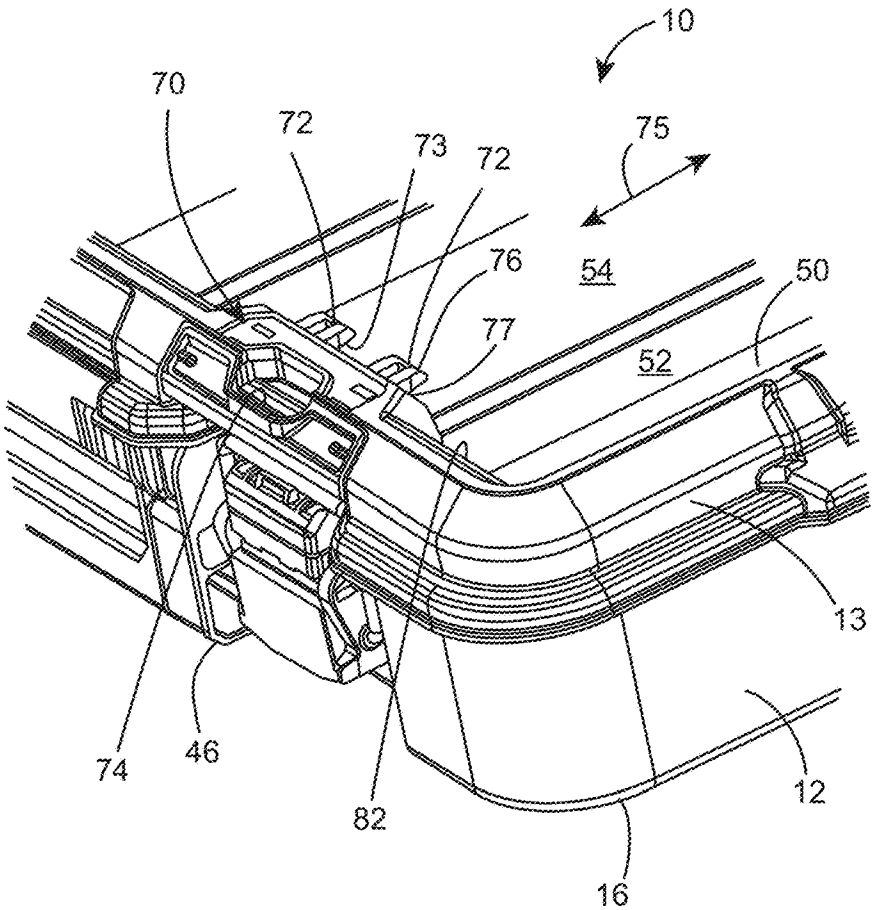
FIG. 4B is an enlargement of the portion marked 4A in FIG. 1, however with the locking latch at its locked position.
Figure 4A:
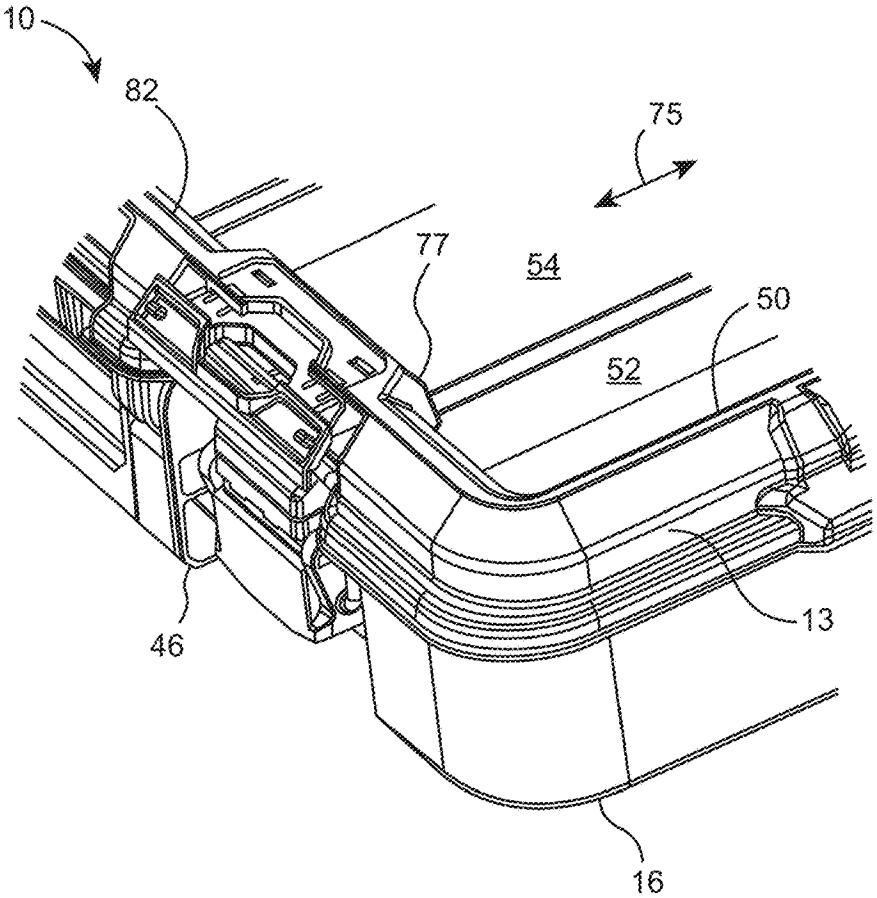
FIG. 4A is an enlargement of the portion marked 4A in FIG. 1, where the locking latch is at its unlocked position.
Figure 4C:
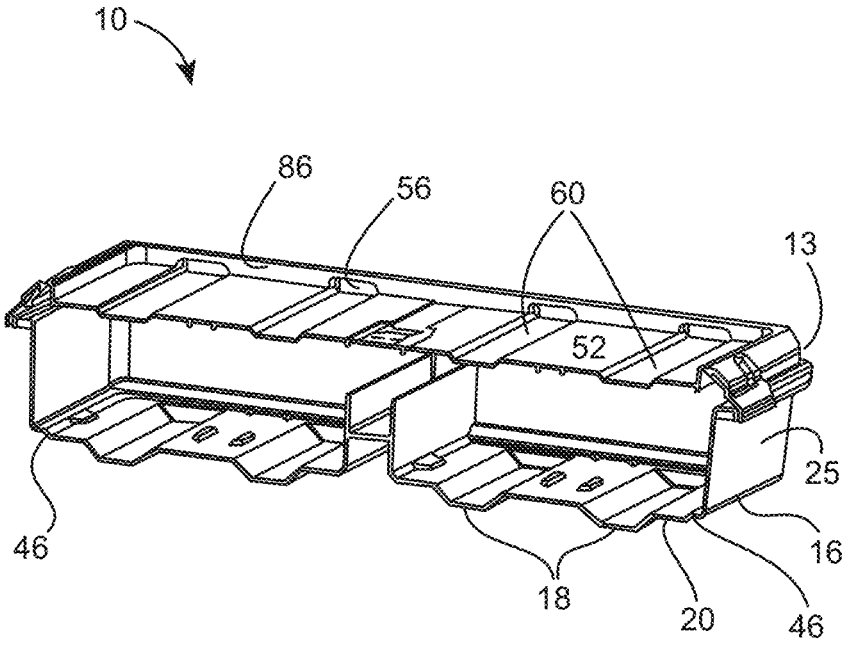
FIG. 4C is a section taken along line 4C-4C in FIG. 1.
Figure 4D:
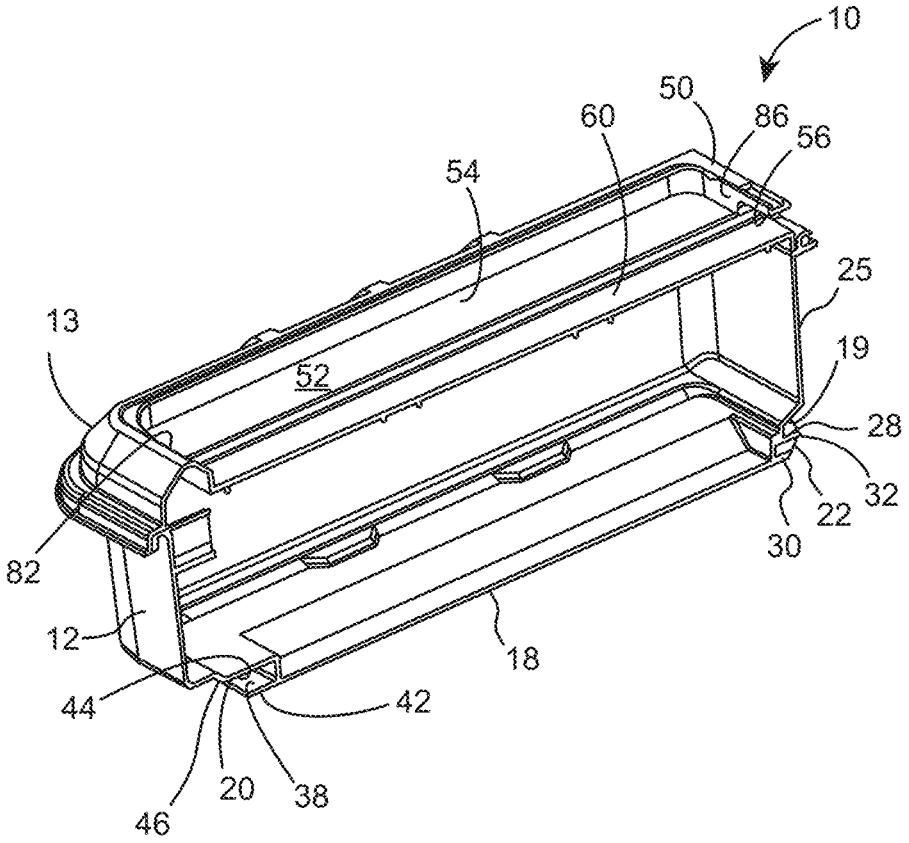
FIG. 4D is a section taken along line 4D-4D in FIG. 1.
Figure 4E:
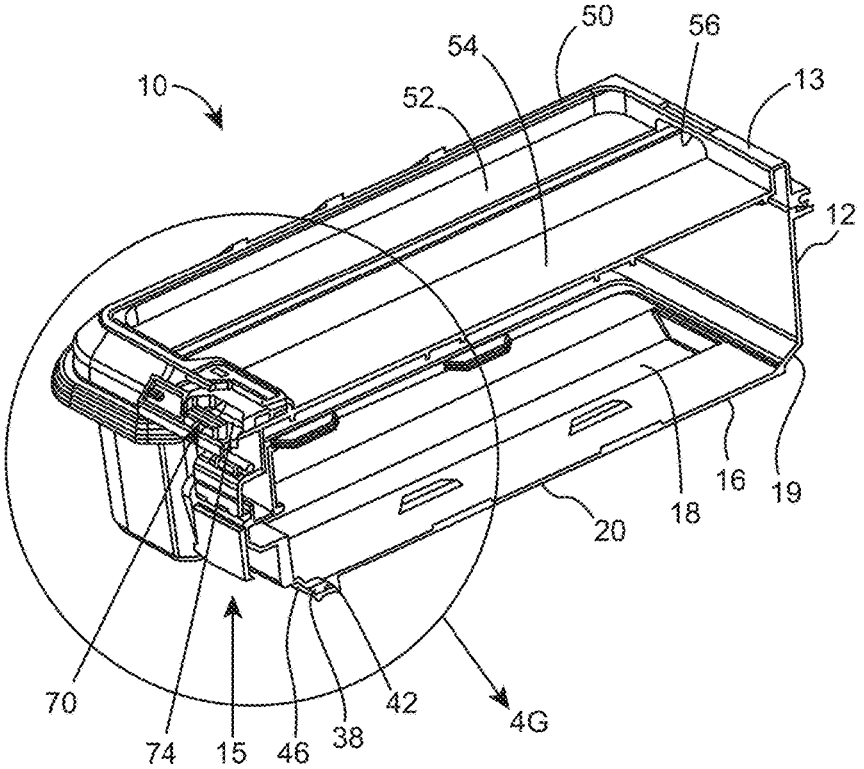
FIG. 4E is a section taken along line 4E-4E in FIG. 1, the locking latch at its unlocked position.
Figure 4F:
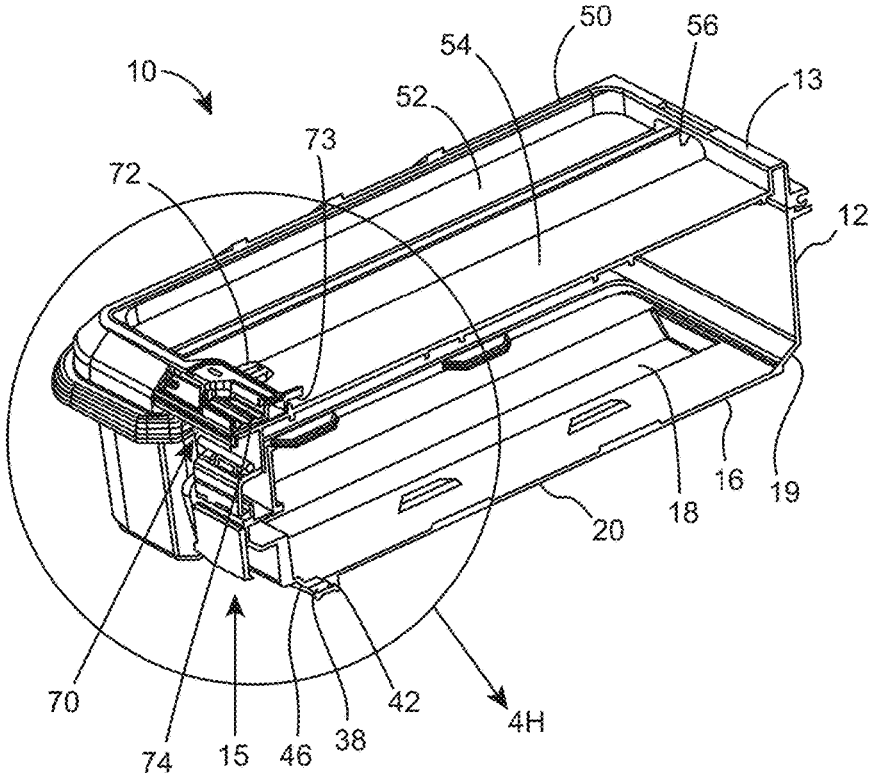
FIG. 4F is a section taken along line 4E-4E in FIG. 1, however with the locking latch at its locked position.
Figure 4H:
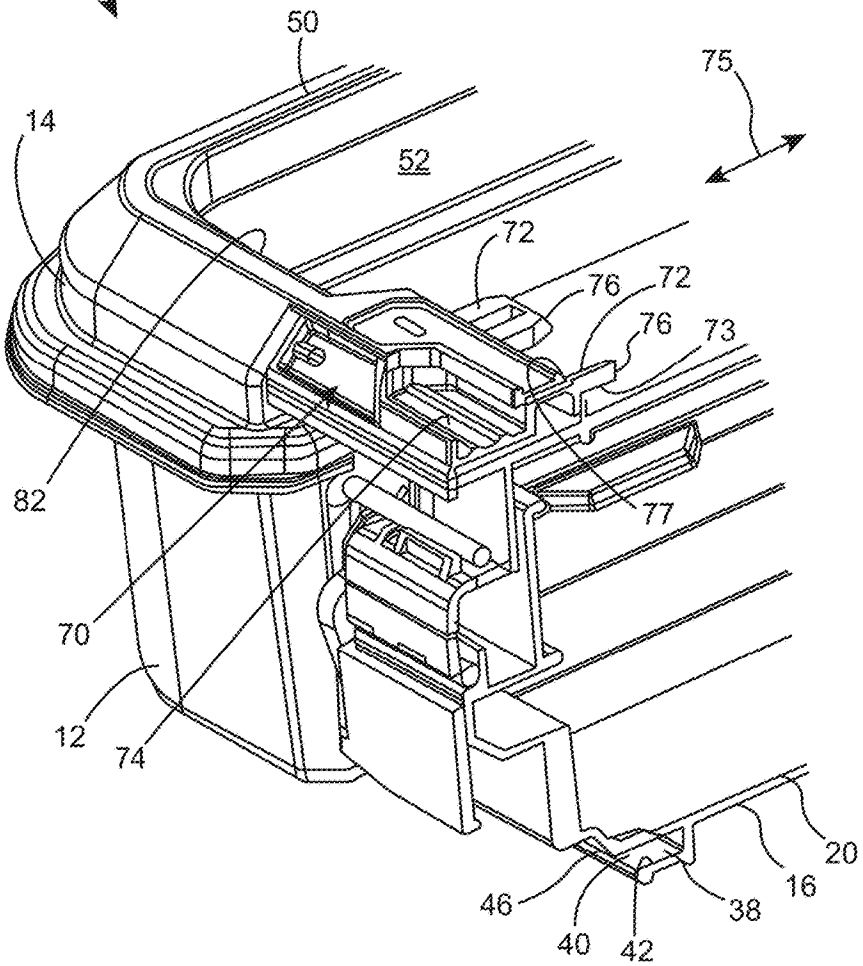
FIG. 4H is an enlargement of the portion marked 4H in FIG. 4F.
Figure 4G:
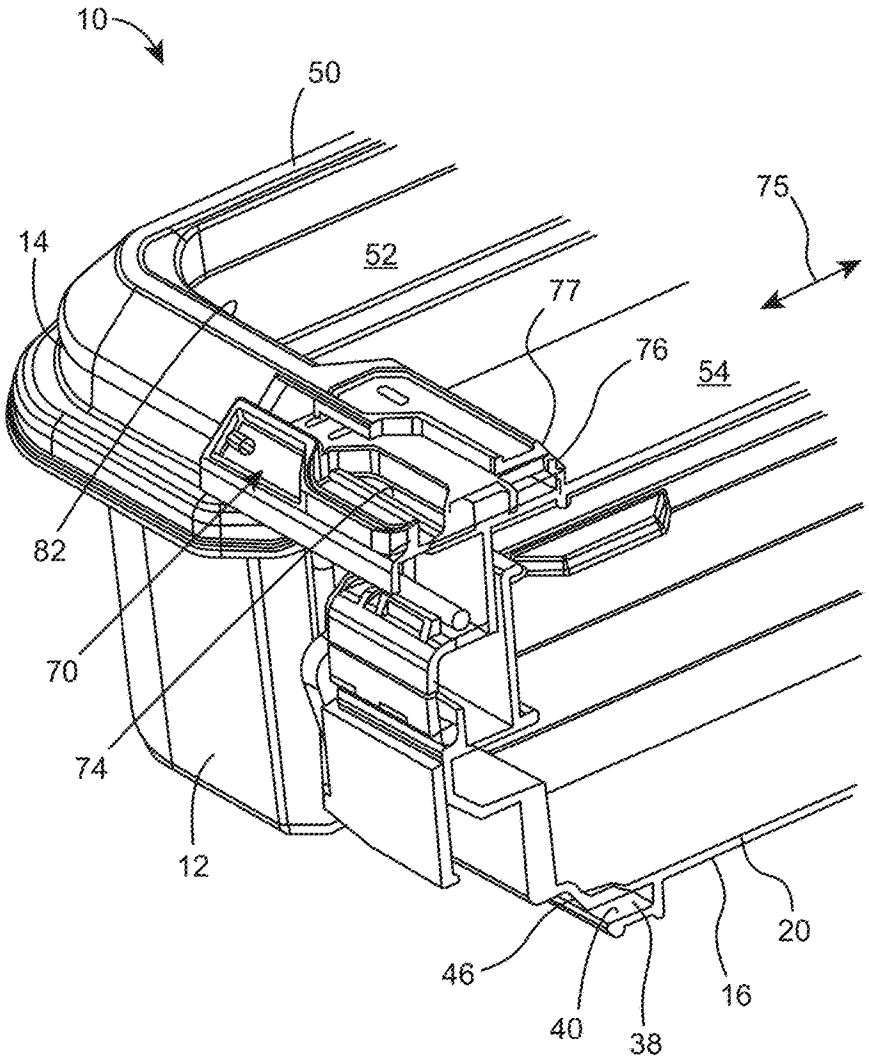
FIG. 4G is an enlargement of the portion marked 4G in FIG. 4E.
Figure 5:
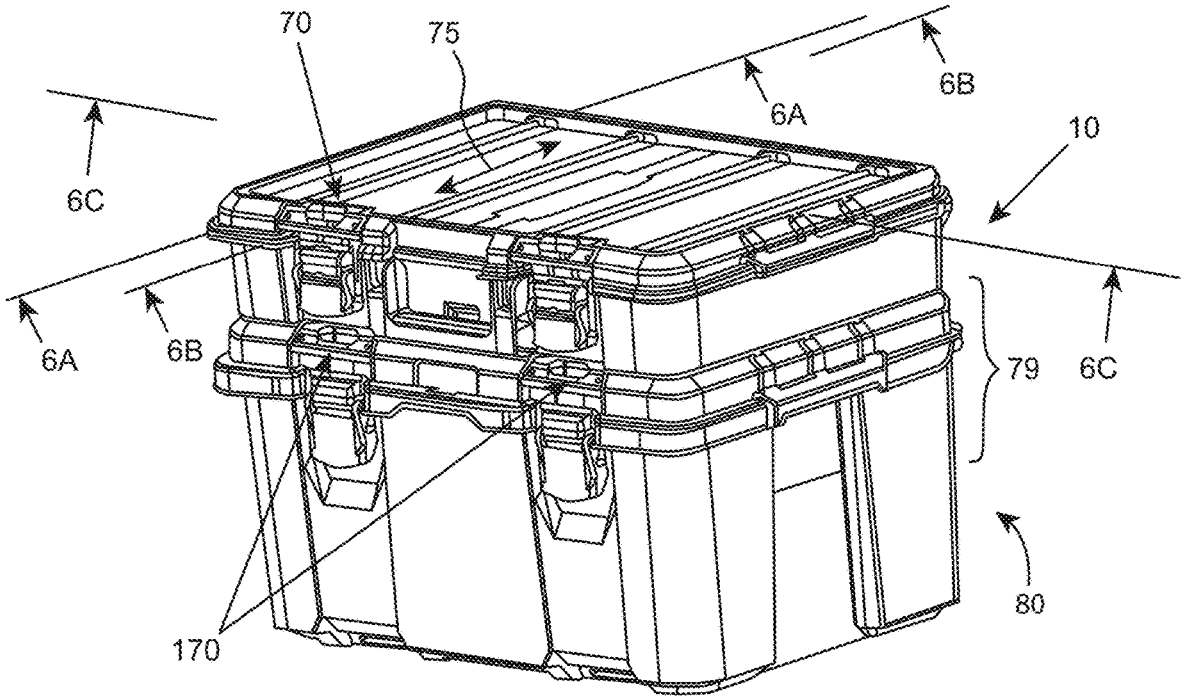
FIG. 5 is a top front perspective view of an example of a utility module assembly according to an example of the disclosure, namely a set of two containers articulated to one another.
Figure 6A:
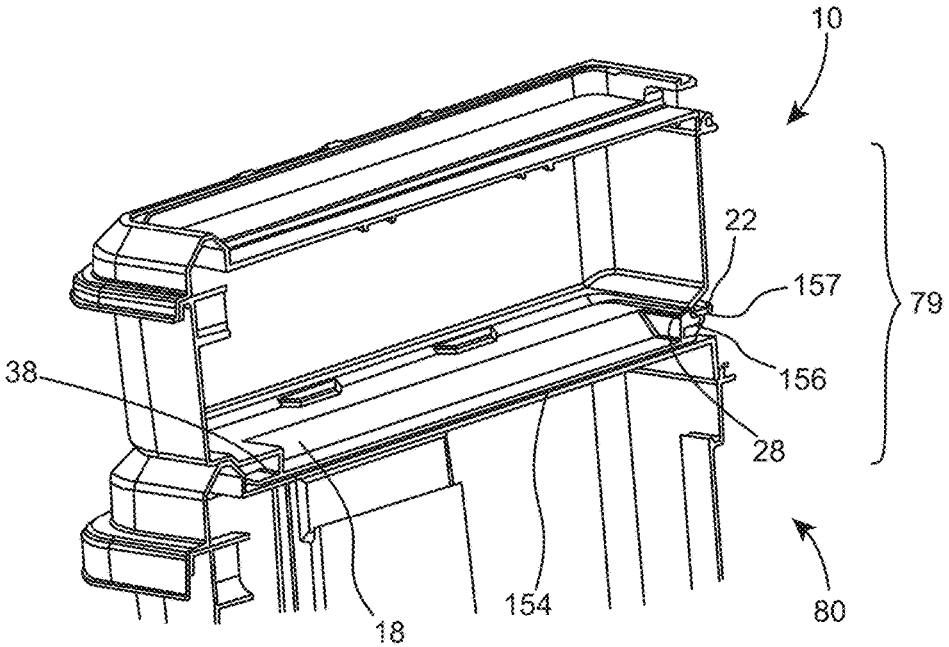
FIG. 6A is a section taken along line 6A-6A in FIG. 5.
Figure 6B:
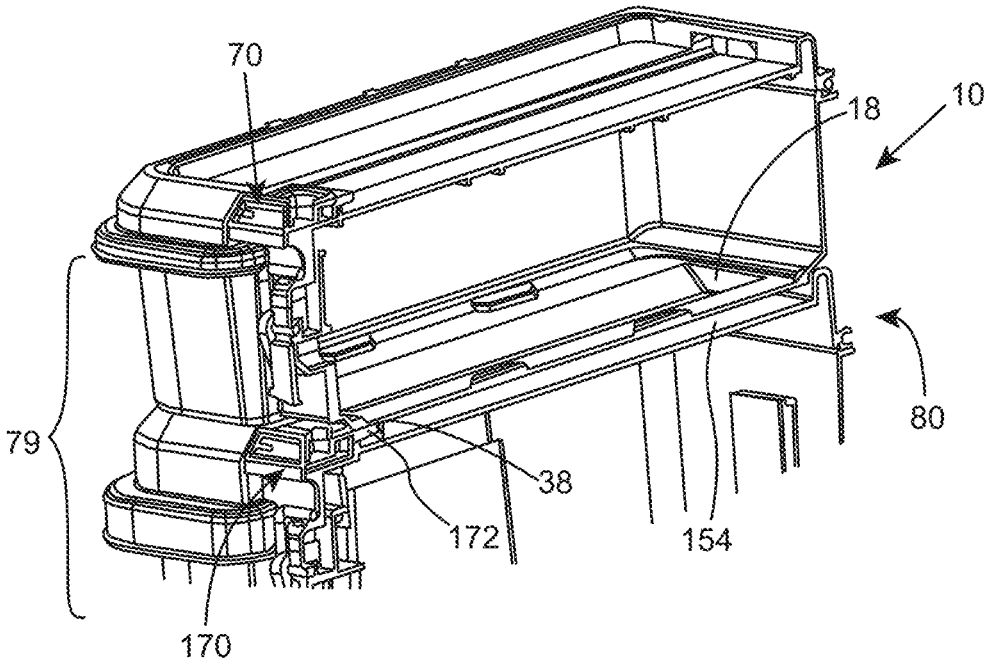
FIG. 6B is a section taken along line 6B-6B in FIG. 5.
Figure 6C:
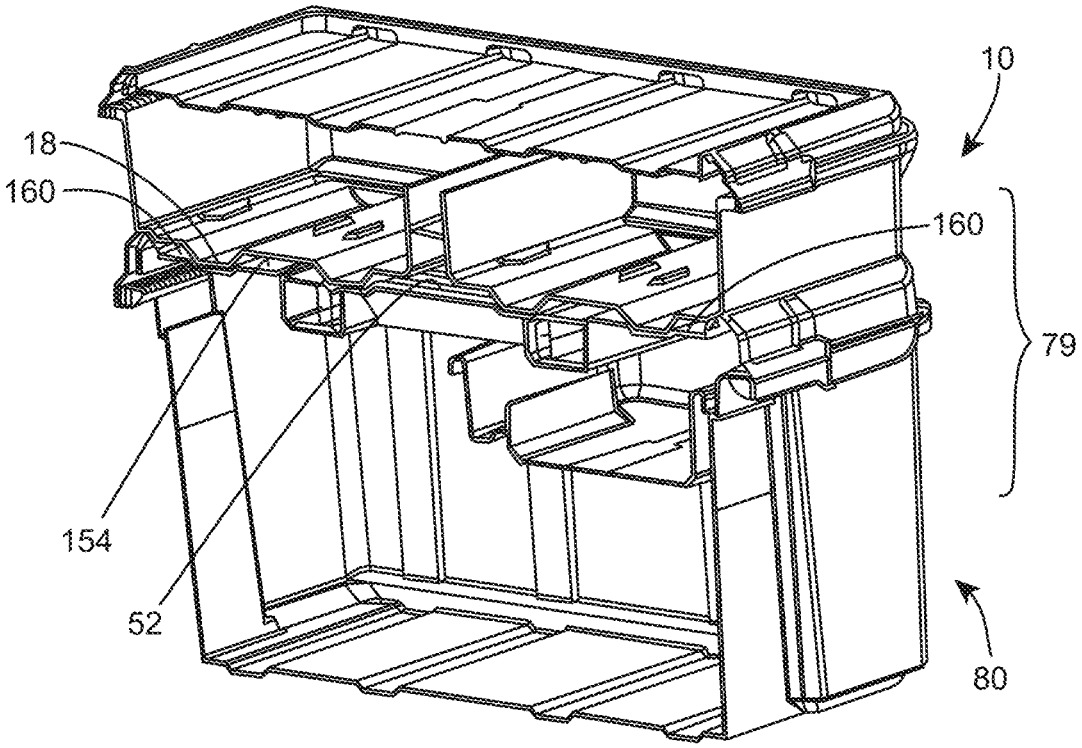
FIG. 6C is a section taken along line 6C-6C in FIG. 5.

Attention is first made to FIGS. 1 to 4H illustrating a utility module according to an aspect of the present disclosure, namely a container, generally designated 10. Whilst in several of the following drawings containers have been used for exemplifying utility modules according to different aspects of the disclosure, it should however be noted that theses are mere examples and the term 'utility module' should be understood in its broad sense, including, without limitation, containers, tool boxes, organizers, transportation dollies, racks and mounts, tools, pieces of equipment and machinery, etc.

The utility module, namely container 10 comprises a rigid body 12 and a cover/lid 13 pivotally articulated thereto at a top back edge thereof. The body 12 comprises a rigid base 16 configured with several (four in the illustrated example) longitudinal ribs 18 projecting from a bottom surface 20 of the base 16, with said ribs 18 extending from a rear edge to a front edge of the base 16. The ribs 18 terminate at their rear end with engaging tabs 22 projecting from an upright wall portion 19 of the base 16 (i.e. substantially vertical, normal to the base surface 20), the engaging tab 22 projecting laterally backwards from the base 16, however not exceeding behind a back wall 25 of the container 10.

The engaging tabs 22 are configured with a top flat face 28 (FIG. 4D), a bottom face 30 (in the particular example coextending with the respective rib 18) and having a slanted end 32.

An opposite side, namely a front side of the base portion 16 of the container 10, is configured with several (two in the illustrated example) locking receptacles 38 having a generally inverted U-like shape, each having a front facing opening 40 (best seen in FIGS. 4G and 4H), with a flat bottom surface 42 and a flat top surface 44. It can be seen that the locking receptacles 38 are disposed parallel with said engaging tabs 22 however axially shifted (i.e. not disposed along the same axis), and facing away from one another.

It is also seen that the base 16 has a tapering front portion 44 and tapering side portions 46, said tapering portions configured for assisting in true-positioning of the container over another utility module as will be seen with reference to the assemblies illustrated and discussed hereinafter.

The container 10 of the disclosure is configured with complete connectivity features, facilitating it to be articulated over another utility module as will be discussed hereinafter) and/or facilitating another utility module to be articulated over it. However, it is appreciated that according to the present disclosure, a utility module can be configured with either or both connectivity features, namely those facilitating connecting the specific utility module to an other utility module, or those facilitating articulating said other utility module to the specific utility module.

The pivotal lid 13 functions as a rigid mounting platform, and is lockable to the body 12 by a clasp closure 15. The lid 13 has an annular rim/skirt 50 extending from a surface 52 and defining a utility module arresting space 54, with four tab arresting receptacles 56 at a first location (rear side of the rim 50), said tab arresting receptacles 56 coextending from longitudinal depressions 60, said depressions extending from a front end to a rear end of the arresting space 54.

At a second of location of the lid 13, namely at a front side of the rim 50, there are configured two locking latches 70 (FIGS. 4A and 4B) extending within the rim 50 and having a pair of locking tongues 72 extendable into the arresting space 54 and a manipulating portion 74 disposed external to said rim 50. The locking latches 70 are slidingly displaceable between a locked position where the locking tongues 72 project into the arresting space 54 (FIG. 4B), and an unlocked position (FIG. 4A) wherein the locking tongues 72 are retracted and do not project into the arresting space 54, but rather a slanted fore tip 76 of the locking tongues 72 extends substantially flush with an inside surface 77 of the rim 50, said inside surface 77 tapering outwards. At the locked position, a bottom surface 73 of the locking tongues 72 is spaced from the surface of the arresting space 54.

The engaging tab (locking latches) are displaceable into engagement within the tab arresting receptacles along an axis of the tab arresting receptacle, said axis defining a connectivity path, namely a path of insertion indicated by arrow 75 (parallel to the longitudinal ribs 18 and the respective longitudinal depressions 60). The path of insertion 75 is also the axial detaching manner, though at an opposite sense.

The locking latches 70 are displaceable between their distinct locked and unlocked positions, owing to a snap type location setting extending between the locking latches 70 and the receiving portion within the rim 50. However, it is appreciated that in the present example the locking latches 70 are manually displaceable between their respective positions, though a biasing arrangement can be applied (not shown) to facilitate displacement of the locking latches 70 into a normally locked position. Even more so, the slanted fore tip 76 of the locking latches 70 is configured to cause the locking latches 70 to retract into the unlocked position at the event of a vector force is applied over said slanted tip surface, e.g. at the event of placing a utility module (such as a container) into connectivity with the container 10.

It is seen that the bottom face of the base portion 16 is designed in conformity with the design of the top face of the lid 13, namely as far as the longitudinal ribs 18 and the corresponding longitudinal depressions 60 and yet as far as the tapering side portions 46 and upright wall portion 19 of the base portion 16, corresponding with inside tapering front wall portion 82 and upright rear wall portion 86, whereby placing one utility module over another utility module renders the connectivity system components in register with one another (i.e. the engaging tab 22 are disposed in register with the tab arresting receptacles 56 and the locking receptacles 38 are disposed in register with the locking latches 70, respectively), and further wherein respective bottom surfaces of the base portion of a top utility module bare over respective top surfaces of a bottom utility module, as can be seen with reference to FIGS. 5 to 8B.

Articulating a first utility module with a second utility module is simple and easy. In the following description, with reference being made also to FIGS. 5 to 8B, a utility module set 79 is illustrated, comprising two utility modules. The first utility module is the container 10 illustrated and disclosed in detail with reference to FIGS. 1 to 4H. The second utility module, in the illustrated example, is also a container, similar to container 10 however a larger one, generally designated 80, and wherein like elements are designated with like reference numbers, however shifted by 100.

Figure 7:
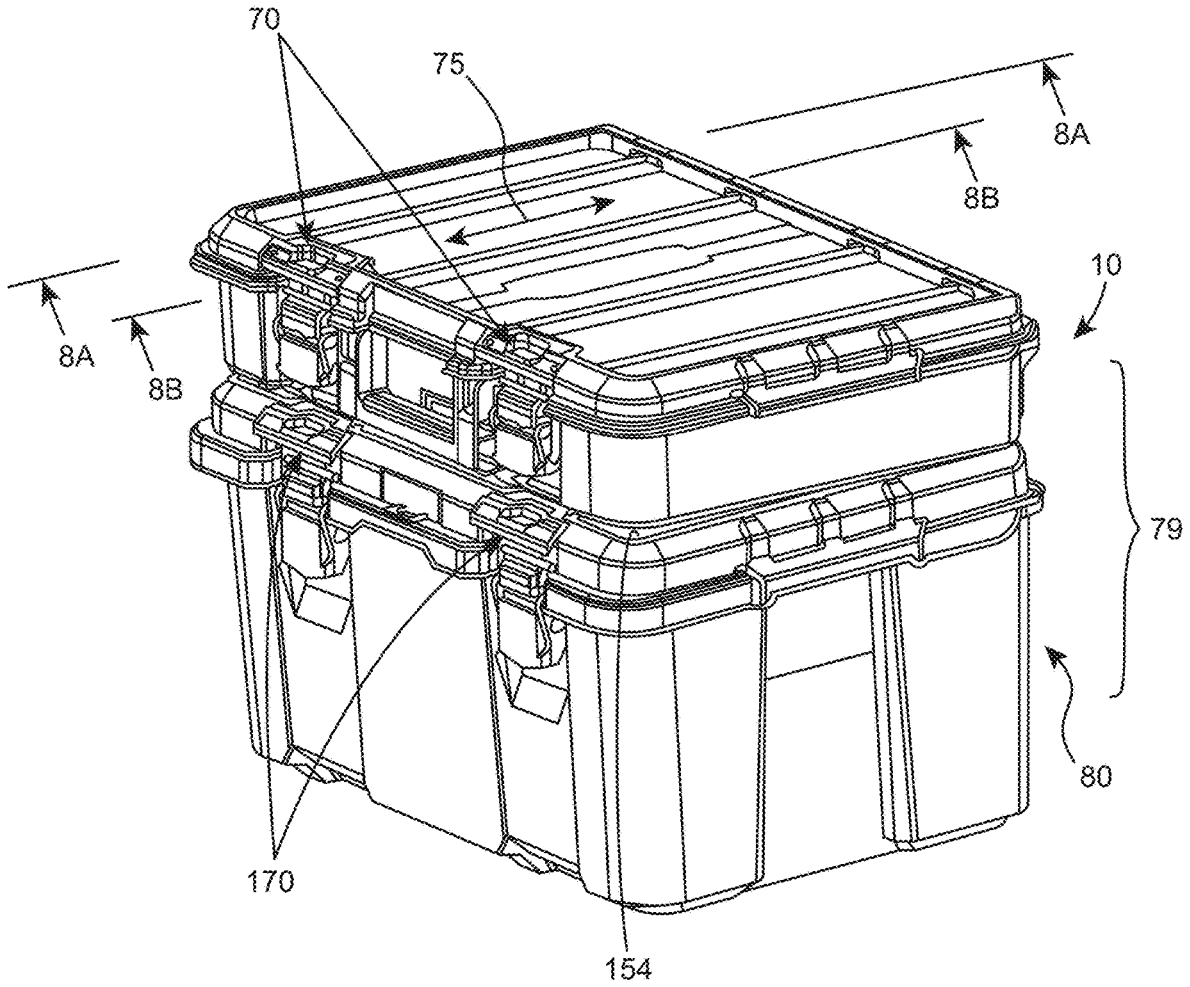
FIG. 7 illustrates the assembly of FIG. 5 with the top utility module at an intermediate engagement step over the second utility module.
Figure 8A:
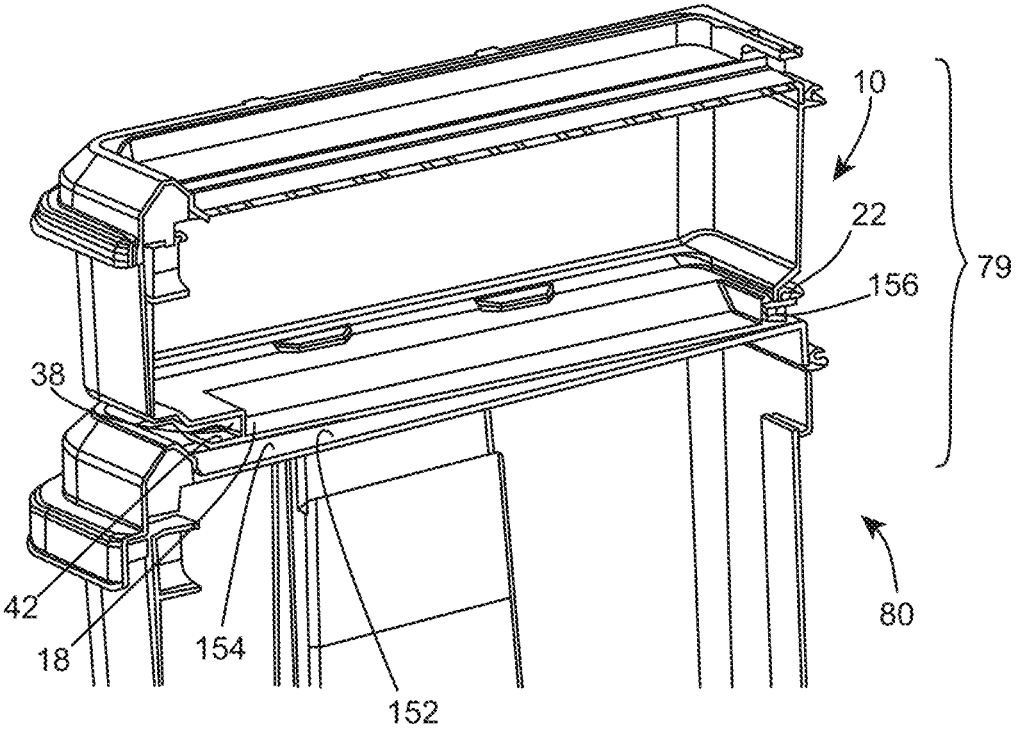
FIG. 8A is a section taken along line 8A-8A in FIG. 7.
Figure 8B:
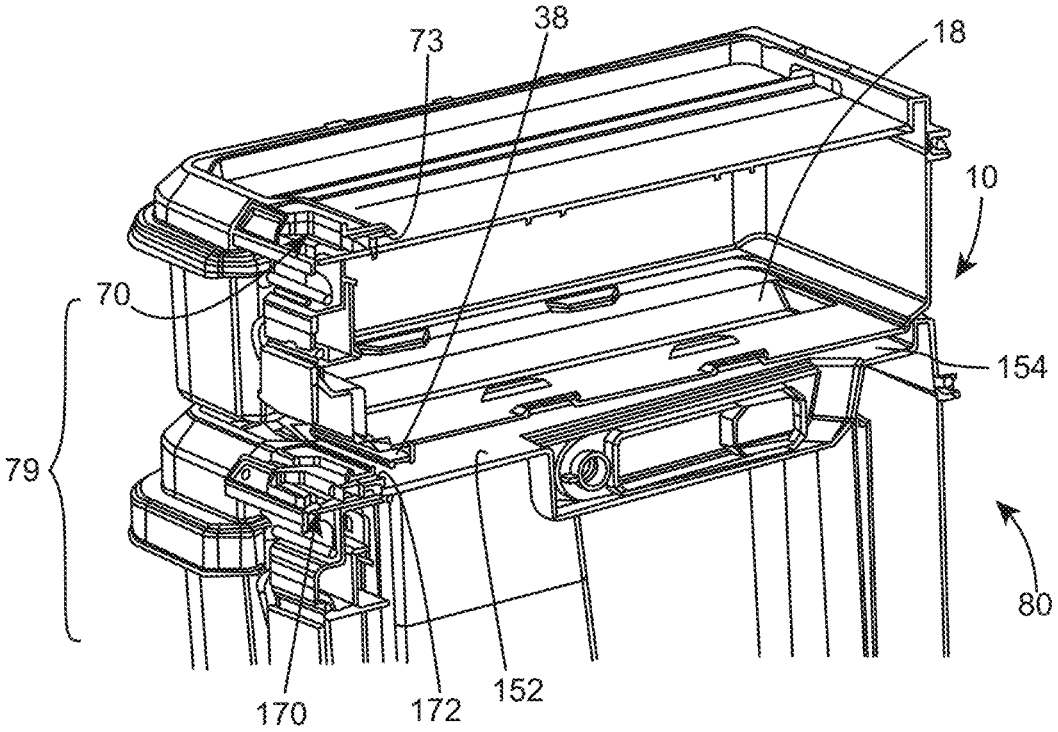
FIG. 8B is a section taken along line 8B-8B in FIG. 7.

For articulating the two utility modules 10 and 80, the first utility module 10 is placed over the second utility module 80 such that the base 16 of the first utility module 10 is allowed to slide within the arresting space 154 of the second utility module 80, namely with longitudinal ribs 18 displacing over longitudinal depressions 160 and bottom surface 20 of the base 16 sliding over surface 152, introducing engaging tabs 22 into the tab arresting receptacles 156. For this purpose, slanted end 32 of the engaging tabs 22 is advantages, as it does not constitute an obstacle upon placing the first utility module 10 tilted over the second utility module 80, in a sliding fashion (FIGS. 7 to 8B).

Once the first utility module 10 comes into place over the second utility module 80, such that the engaging tabs 22 are arrested within the respective tab arresting receptacles 156, the locking latches 170 are displaced (manually sliding in the example; along the path of insertion) into the locked position, whereby the locking tongues 172 are displaced into arresting engagement within tab locking receptacles 38, however over the flat top surface 44, thus arresting the first utility module 10 over the second utility module 80. At the articulated position the base plate 16 of the first utility module 10 is disposed substantially parallel with the arresting space 154 of the second utility module 80.

It is noted, the engaging tabs 22 are configured, as far as shape and size, for snug receiving within the respective shape and dimensions of the top flat surface 28 of the engaging tabs 22 and the height of the tab arresting receptacles 156, whereby at an interlocked position (FIGS. 5 to 6C), when the engaging tabs 22 are received within the respective tab arresting receptacles 156, the top flat face 28 of the engaging tabs 22 are engaged under, at contact tolerance, with a facing surface 157 of the tab arresting receptacles 156.

Noticeable, the length of the base portion 16 of the first utility module 10, measured in the direction of the path of insertion is substantially similar, or slightly less, than the length of the arresting space 154 of the second utility module 80, measured in the same direction, and wherein the length of the base portion 16 of the first utility module 10 including the protruding length of the engaging tabs 22 is greater than the length of the arresting space 154 of the second utility module 80.

In addition, the locking tongues 172 are configured for arresting the locking receptacles 38 such that at the locked position, a bottom surface 173 of the locking tongues 172 bears over the bottom surface 42 of the locking receptacles 38, to thereby eliminate motion freedom between the utility modules at their interlocked, locked position.

The arrangement is such that once at the locked position, the first utility module 10 and second utility module 80 are firmly articulated to one another, with substantially no tolerance, i.e. no free movement, as the base portion 16 is clamped at its position over the arresting space 154, and wherein detaching the utility modules from one another is easily performed simply by unlocking the locking latches 170 and removing the first utility module from the second utility module, where removing the first utility module 10 requires slight upwards tilting the front portion of the first utility module, to facilitate disengaging the engaging tabs 22 from the arresting receptacles 156.

In the illustrated examples hereinabove and hereinafter, the locking latches are displaceable between their respective locked and unlocked positions by axial, sliding displacement, along the path of insertion 75. However, it should be apparent that the locking latches can be configured for displacement about an axis intersecting the path of insertion 75, as will be exemplified hereinafter with reference to FIGS. 9 to 10B. Also, it should be apparent that rather than axial sliding, the locking lathes can be configured for displacement between the respective locked position and unlocked position through rotational or pivotal manipulation (not shown).

Figure 9:
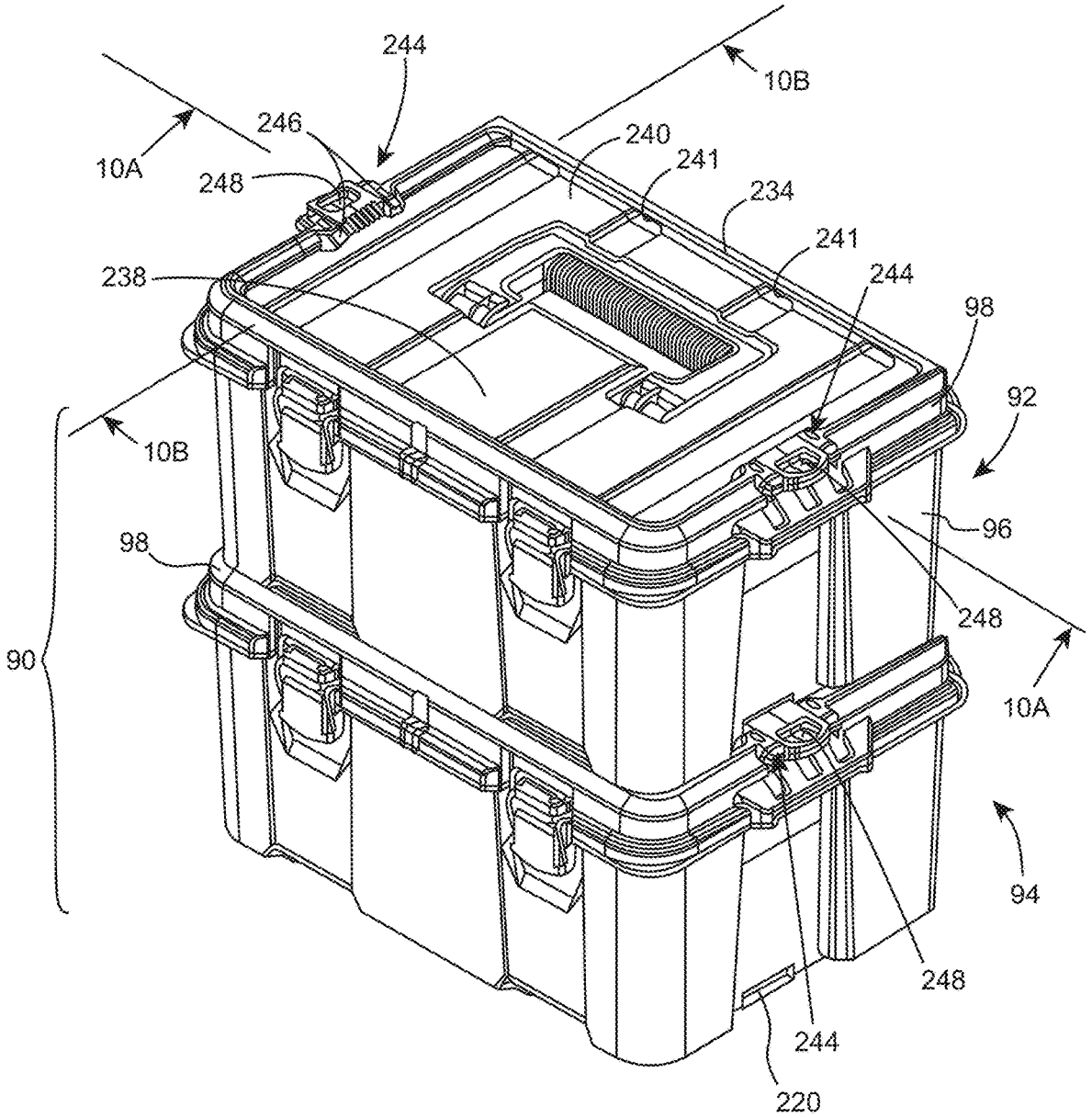
FIG. 9 is a top front perspective view of yet an example of a utility module assembly according to the disclosure, namely a set of two containers articulated to one another.
Figure 10B:
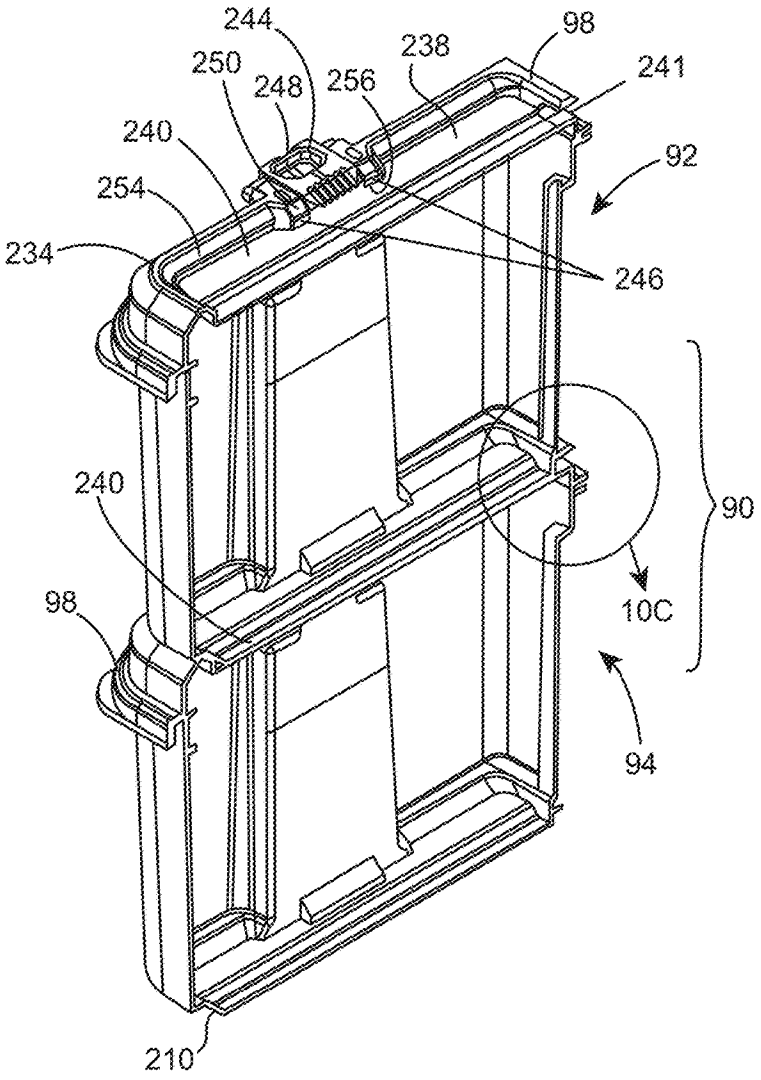
FIG. 10B is a section taken along line 10B-10B in FIG. 9.
Figure 10A:
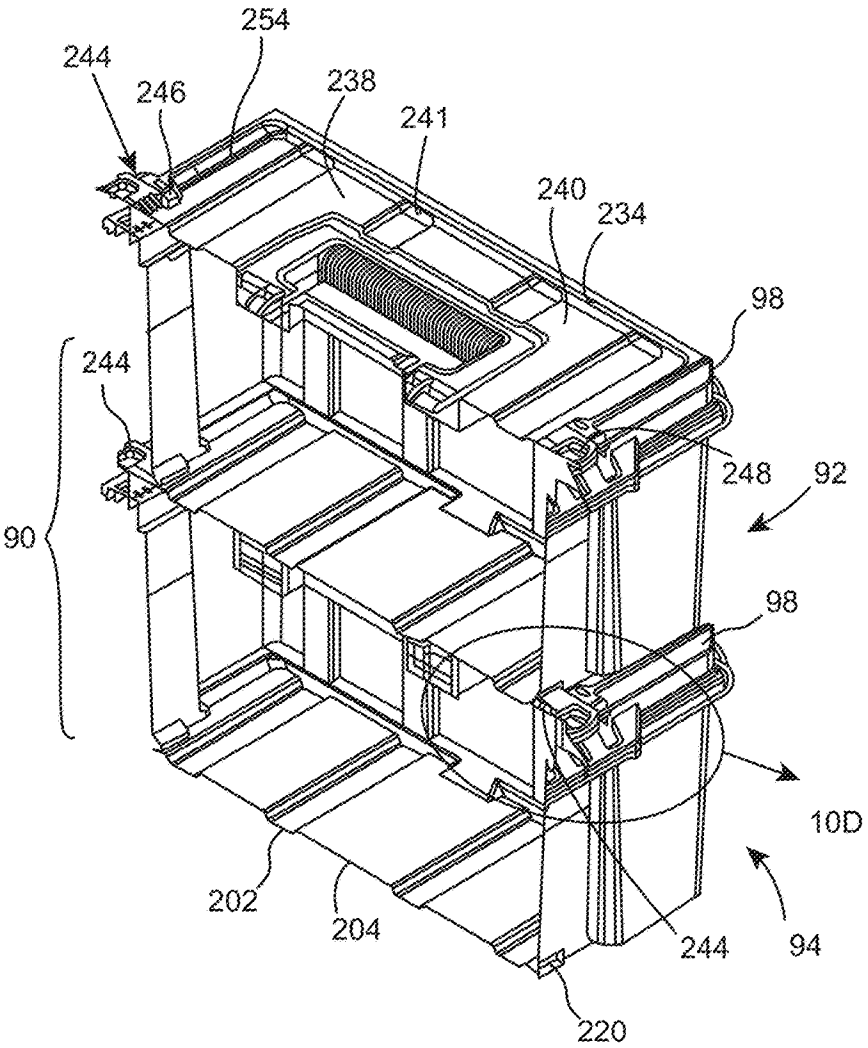
FIG. 10A is a section taken along line 10A-10A in FIG. 9.
Figure 10D:
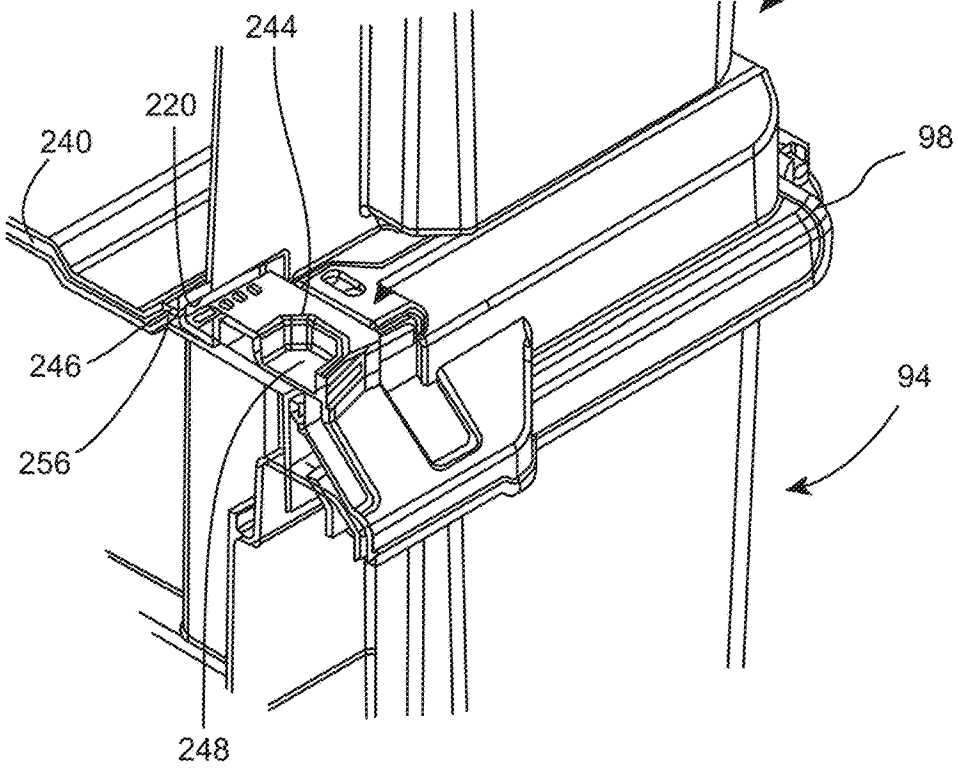
FIG. 10D is an enlargement of the portion marked 10D in FIG. 10A.
Figure 10C:
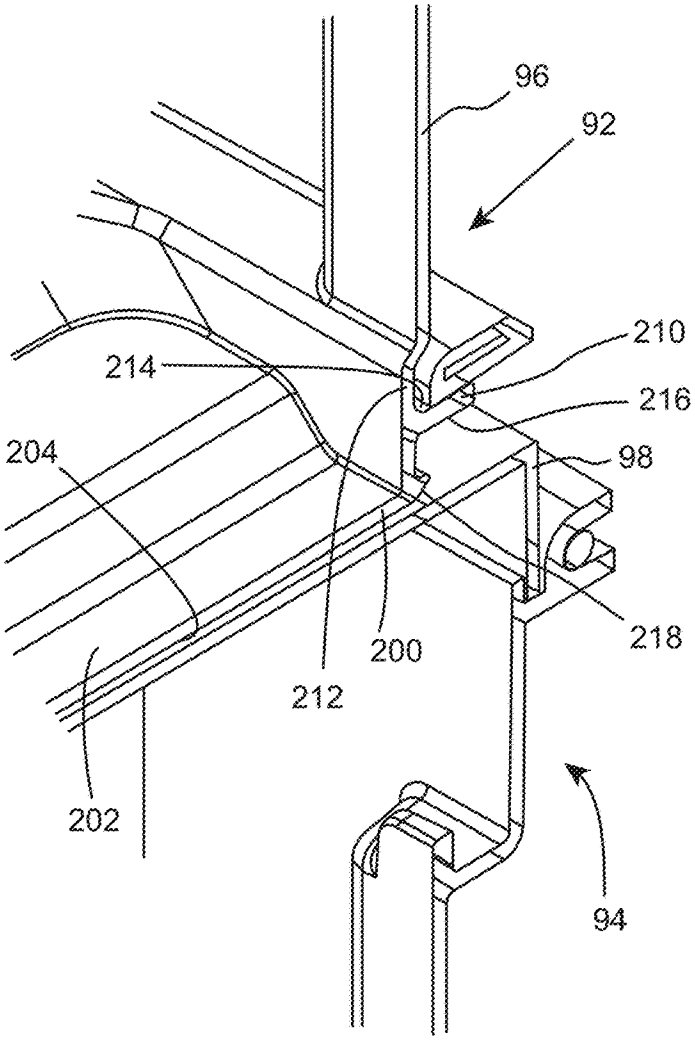
FIG. 10C is an enlargement of the portion marked 10C in FIG. 10B.
Figure 11:
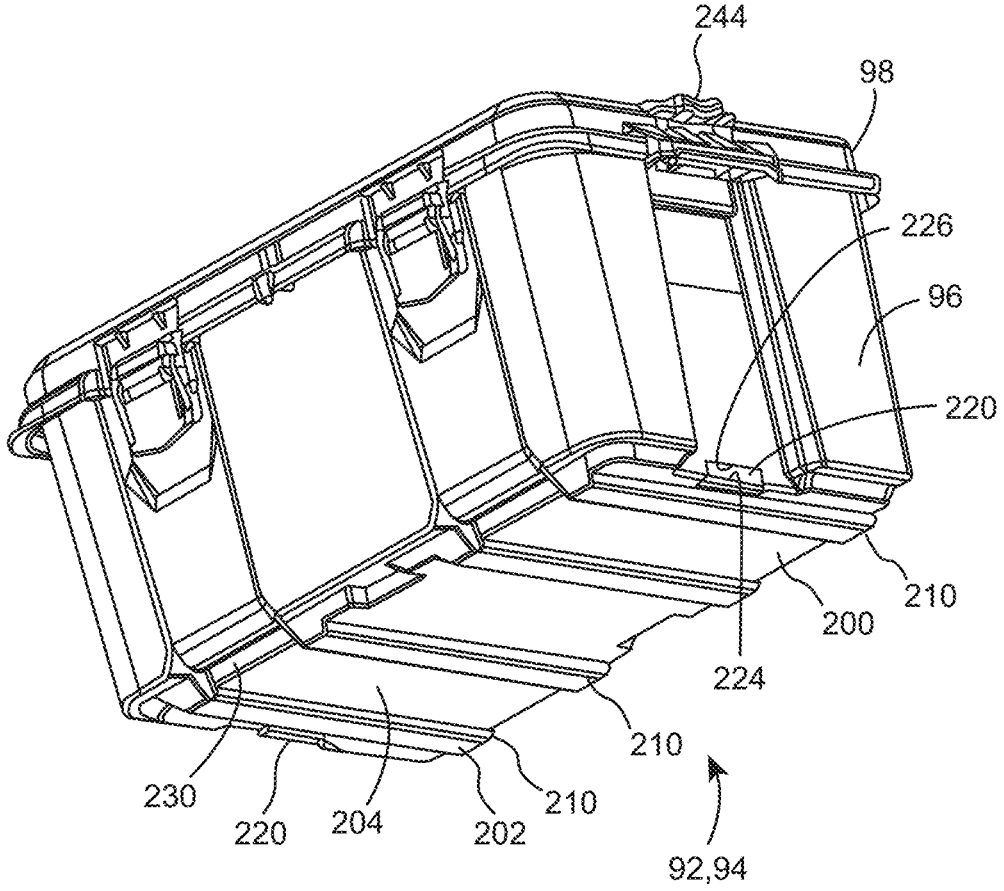
FIG. 11 is a bottom perspective view of a utility module seen in FIG. 9.
Figure 12A:
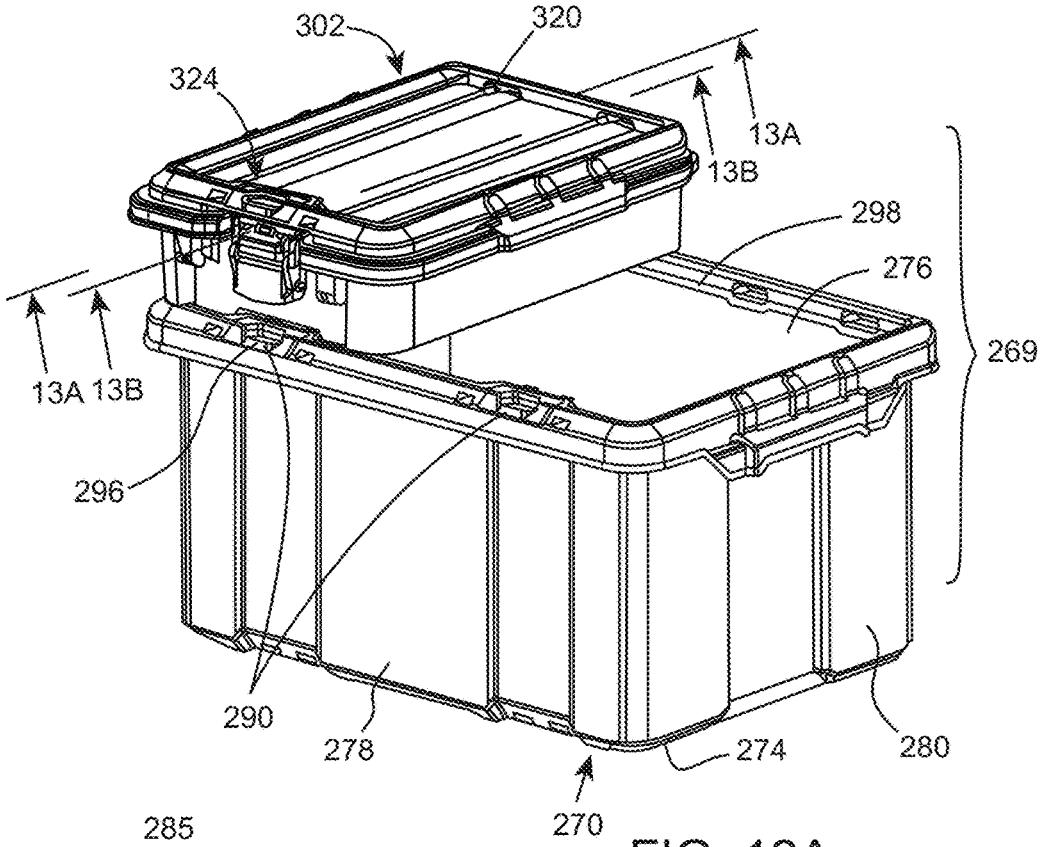
FIG. 12A is a top front perspective view of an example of a utility module assembly according to the disclosure, namely a container articulated over an open-top container.
Figure 12B:
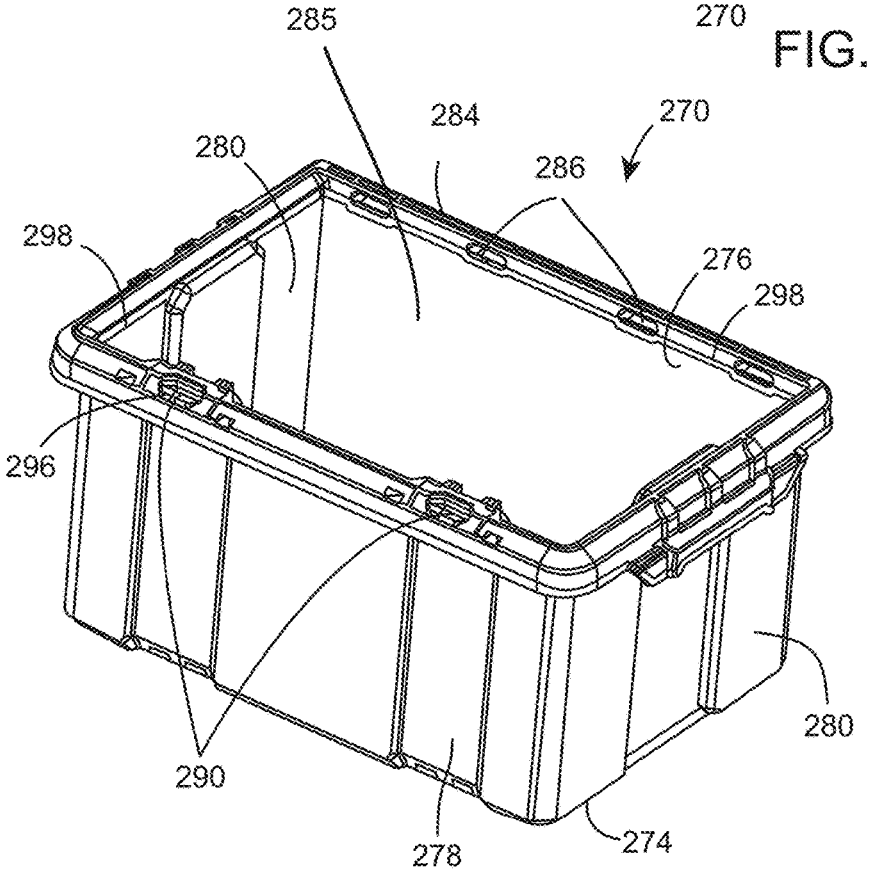
FIG. 12B is atop perspective view of only the open-top container seen in FIG. 12A.
Figure 13A:
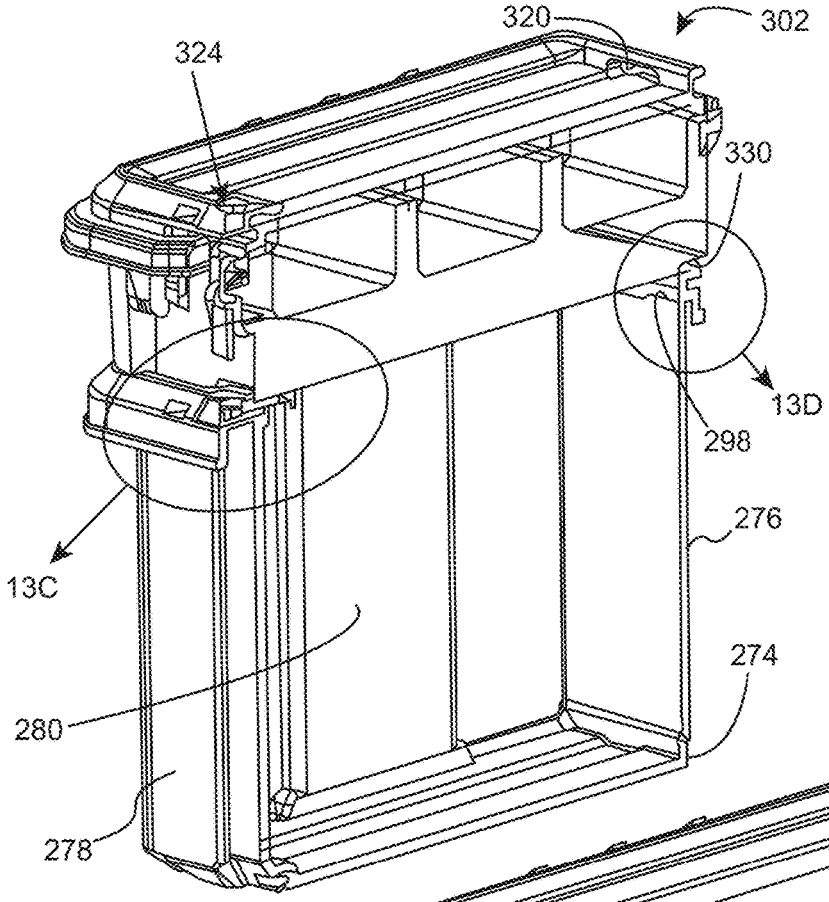
FIG. 13A is section taken along line 13A-13A in FIG. 12A.
Figure 13B:
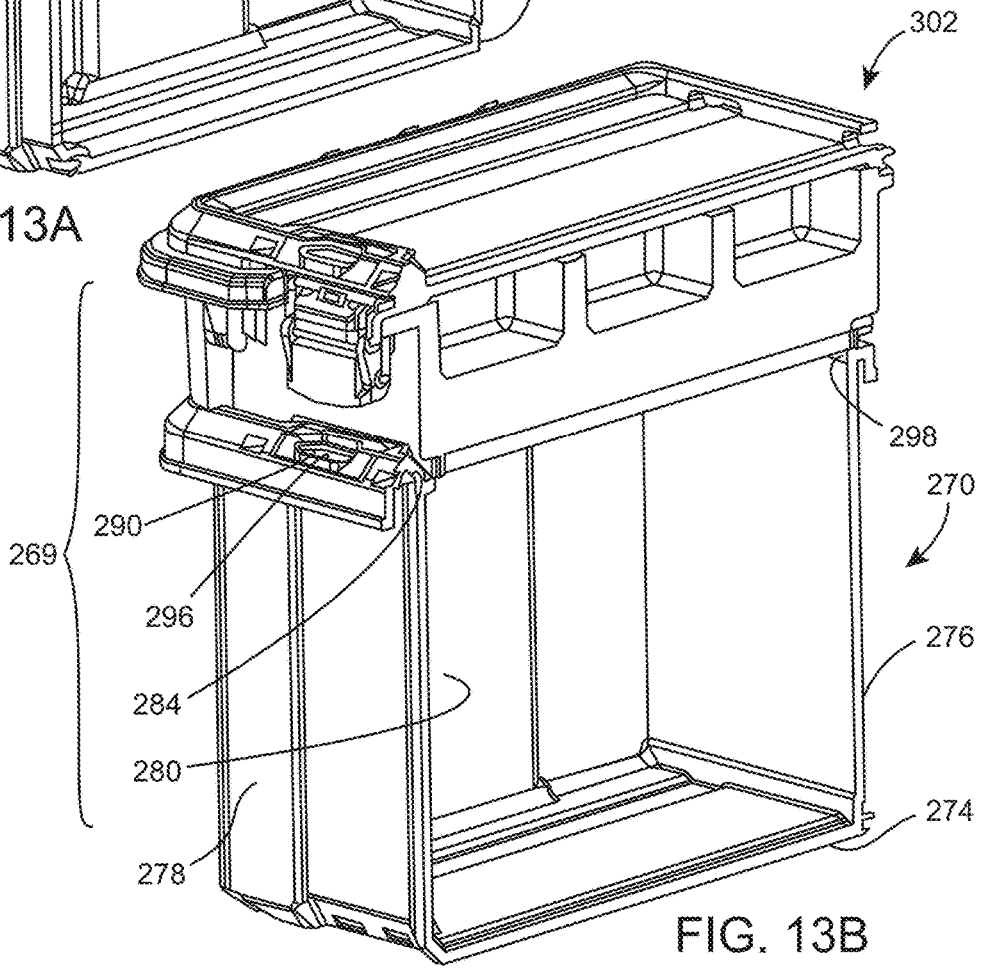
FIG. 13B is section taken along line 13B-13B in FIG. 12A.
Figure 13D:
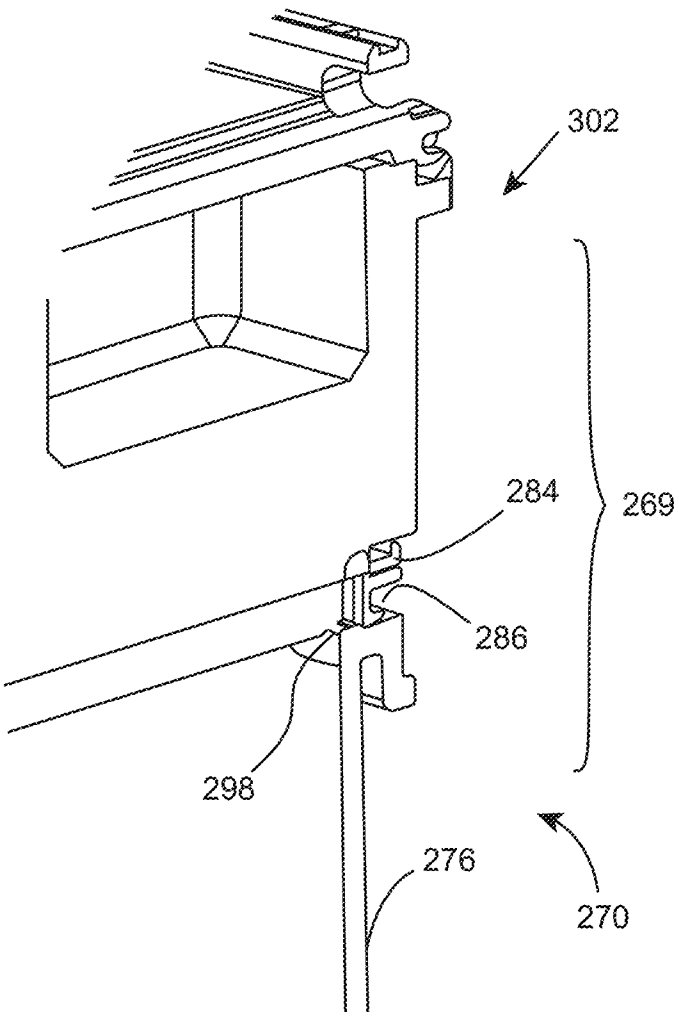
FIG. 13D is an enlargement of the portion marked 13D in FIG. 13A.
Figure 13C:
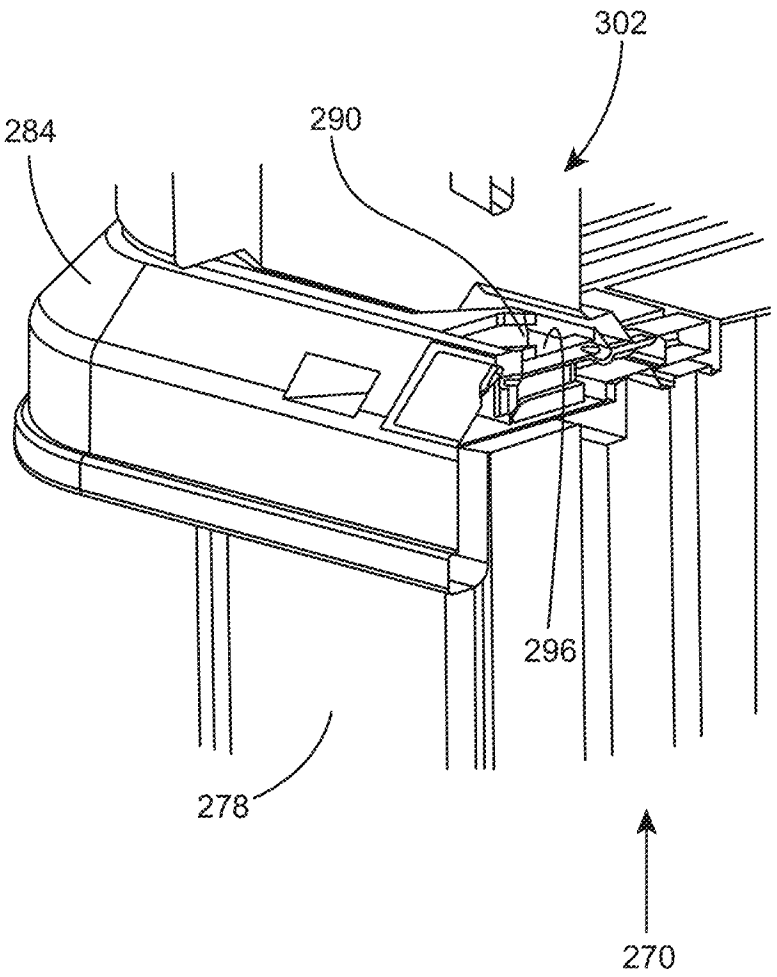
FIG. 13C is an enlargement of the portion marked 13C in FIG. 13A.

Further attention is now directed to FIGS. 9 to 11, directed to an embodiment of the disclosure, however following the same principals. In the example of FIGS. 9 to 11 there is illustrated a container assembly generally designated 90, comprising a first utility module 92 (namely the top container) and a second utility module 94 (the bottom container), though is this example the two utility modules 92 and 94 are identical and thus the following description applies to both the containers.

Similar to the previous example, the utility modules 92 and 94 have a rigid body 96 and a cover/lid 98 pivotally articulated thereto at a top back edge thereof. The body 96 comprises a rigid base 200 (FIG. 11) configured with several (four in the illustrated example) longitudinal ribs 202 projecting from a bottom surface 204 of the base 200, said ribs 202 extending from a rear edge to a front edge of the base 200, said ribs terminating at engaging tabs 210. The engaging tabs 210 project from an upright rear wall portion 212 (FIG. 10C) of the base 200 (i.e. substantially vertical, normal to the bottom surface 204) and terminate such that their rear end, projecting laterally backwards from the base 200, does not exceeding behind a back wall of the container. The engaging tabs 210 are configured with a top flat face 214 (FIG. 10C), a bottom face 216 and having a slanted end 218.

Unlike the previous example, in the present embodiment locking receptacles 220 are disposed at respective side wall portions of the base 200, such that they do not extend along the path of insertion. However, said locking receptacles 220 being similar to those of the previous example, namely having a generally inverted U-like shape, each having a side facing opening, with a flat bottom surface 224 and a flat top surface 226.

It is also seen that the base 200 has a tapering skirt portion 230 configured for assisting in positioning the container over another utility module as will be seen with reference to the assemblies illustrated and discussed hereinafter.

Similar to the previous example, the containers 92, 94 are each configured with complete connectivity features, facilitating it to be articulated over another utility module and/or facilitating another utility module to be articulated over it.

The pivotal lid 98 constitutes a rigid mounting platform, having an annular rim/skirt 234 extending from a surface 238 and defining a utility module arresting space 240, with four tab arresting receptacles 241 at a first location (namely a back side of the rim 234), said tab arresting receptacles 241 being thoroughgoing apertures extending through the rim 234.

At a second of location of the lid 98, namely at an opposite side portions thereof, there are configured two locking latches 244, facing each other, and each having a pair of locking tongues 246 extendable into the arresting space 240 and a manipulating portion 248 disposed external to said rim 234. The locking latches 244 are slidingly displaceable between a locked position where the locking tongues 246 project into the arresting space 240, and an unlocked position wherein the locking tongues 246 are retracted and do not project into the arresting space 240, and their slanted fore tip 250 extends substantially flush with an inside surface 254 of the rim 234, said inside surface 254 tapering outwards. At the locked position, a bottom surface 256 of the locking tongues 246 is spaced from the surface of the arresting space 240.

Contrary to the previous example, in the present example the locking tongues 246 i.e. locking latches 244, are displaceable into engagement within the locking receptacles 220 along an axis normal to that the tab arresting receptacles, (i.e. the connectivity path). Other features of the connectivity system and the utility module system being substantially similar to those described hereinabove, mutatis mutandis.

The side locking latches cab be in addition or instead of locking latches disposed at the front side of the utility module. However. when the locking latches are displaceable along an axis normal to the path of insertion (i.e. the axis of displacement of the engaging tabs into tab arresting receptacles), than the foot print of the rigid base portion of the first utility module can be smaller than the foot print of the arresting space of the second utility module. Thus, at the event that the foot print of the rigid base portion of the first utility module being smaller than the foot print of the arresting space of the second utility module, then the first utility module can be slidingly displaced into locking arresting of the engaging tabs with the respective tab arresting receptacles without the need to tilt the first utility module.

Turning now to FIGS. 12A to 13D, there is illustrated yet another example of a utility module and a utility system 269, according to an embodiment of the present disclosure. In this example there is illustrated a utility module 270 (FIGS. 12A and 12B) configured as an open top container, i.e. devoid of a lid. Nevertheless, container 270 is configured with a complete set of connectivity features according to the disclosure.

Accordingly, the container 270 is a bucket-like container configured with a rigid base portion 274 (FIGS. 13A and 13B) with upwardly extending front wall 276, rear wall 278 and two side walls 280, defining together a top rim 284 constituting a rigid mounting platform, wherein an arresting space 285 is defined by the boundaries of the rim 284. A rear portion of the rim 284 is configured with four tab arresting receptacles 286, in the form of thoroughgoing openings, and a front portion of the rim slidingly accommodated two locking latches 290, extending within the rim 284 into the arresting space 285 (at their locked position), and having a manipulating portion 296 disposed external to said rim 284. An annular inside shoulder 298 is configured below the rim, wherein said rim can be continuous or intermitted. In fact, the rigid mounting platform with the arresting space 285, the tab arresting receptacles 286 and locking latches 290 are similar by construction to the previous examples, with the exception of emittance of a rigid surface.

The rigid base 274 of the container 270 is configured with respective engaging tabs and locking receptacles, rendering the container 270 suitable for constituting a 'first utility module', i.e. suitable for mounting over another utility module of same nature, configured in turn with complimentary connectivity components, namely locking latches and tab arresting receptacles.

Figure 17A:
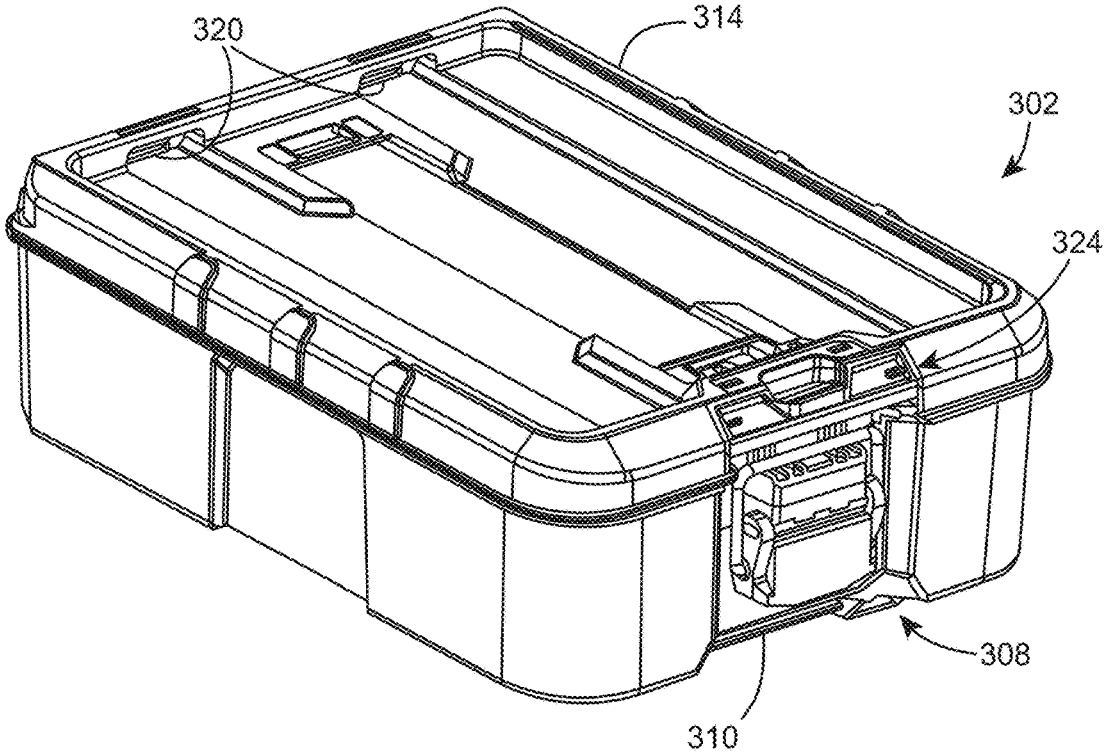
FIG. 17A is a top perspective view of another example of a utility module, namely a container, configured with a connectivity system according to the disclosure.
Figure 17B:
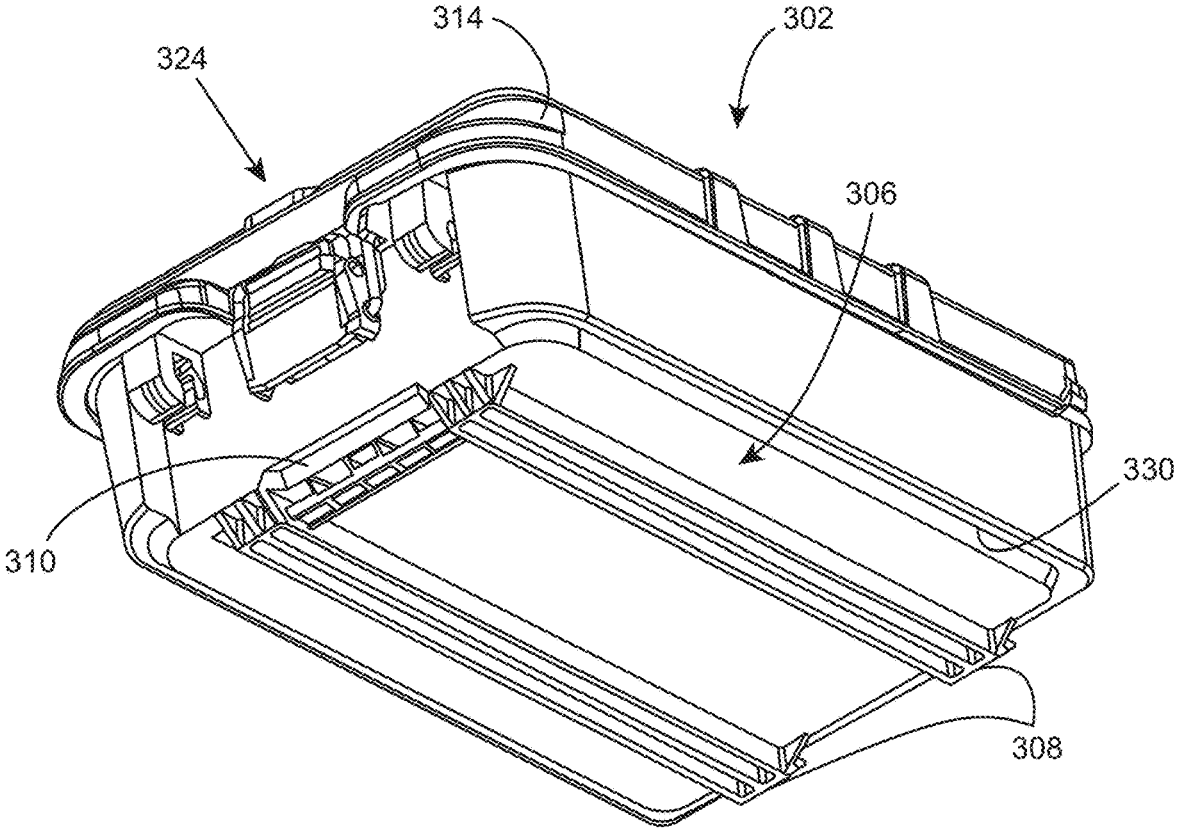
FIG. 17B is a bottom view of the utility module of FIG. 17A.

In FIGS. 12A and 13A to 13D the container 270 is however considered as a second utility module, having articulated thereto, over a portion of its open top, a first utility module, namely a small container 302, seen isolated in FIGS. 17A and 17B. Apart for its size, container 302 is similar to any of the containers (utility modules) disclosed hereinabove and reference is made back for further details concerning the connectivity features thereof, namely its rigid base portion 306 configured with engaging tabs 308 at a back side and a single tab arresting receptacle 310 at a front side. Likewise, it is noted a lid 314 is pivotally articulated at a top of the container 302, the lid configured in turn with connectivity features, namely tab arresting receptacles 320 and a single sliding locking latch 324.

However, at an articulated position, the first utility module, i.e. container 302 occupies only a portion of the arresting space 285 whereby an additional small sized container (not shown) can be placed for covering the entire open top container 270. Alternatively, a full sized utility module can be articulated over the open-top container.

It is noted that articulating the container 302 over container 270 is facilitated exactly as described in connection with the first example, and wherein an annular skirt 330 of the base portion 306 is supported over the annular shoulder 298. Arresting of the container 302 over container 270 is likewise facilitated by locking tabs engaging respective tab arresting receptacles and the locking latches are displaced into locking latches arresting with the locking receptacles.

Figure 14A:
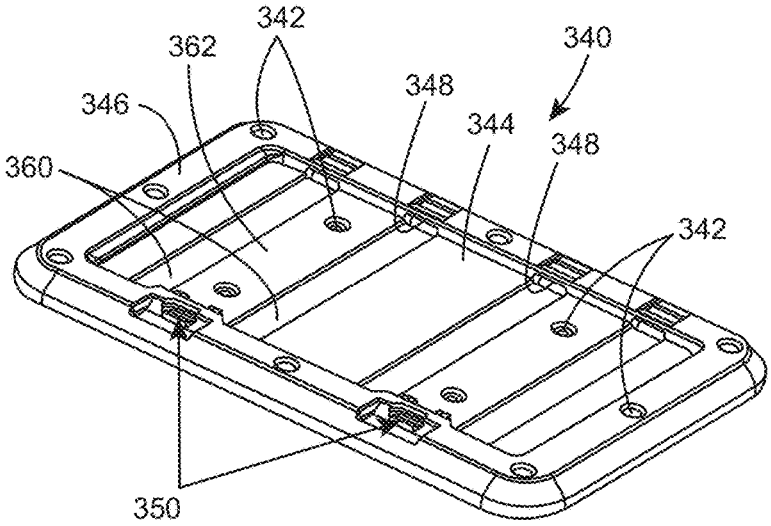
FIG. 14A is a perspective view of a mounting platform configured with a connectivity system according to an aspect of the disclosure.
Figure 14B:
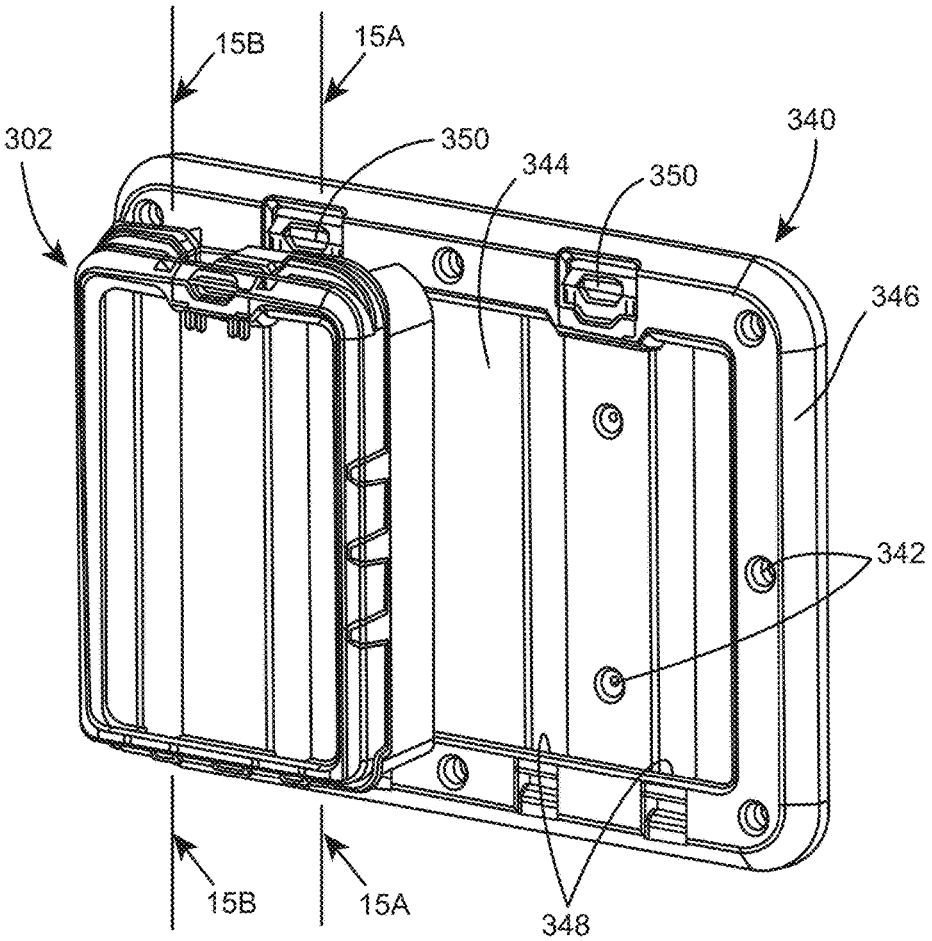
FIG. 14B illustrates the connectivity platform of FIG. 14A at a wall-mounting position with a container articulated thereto.
Figure 15A:
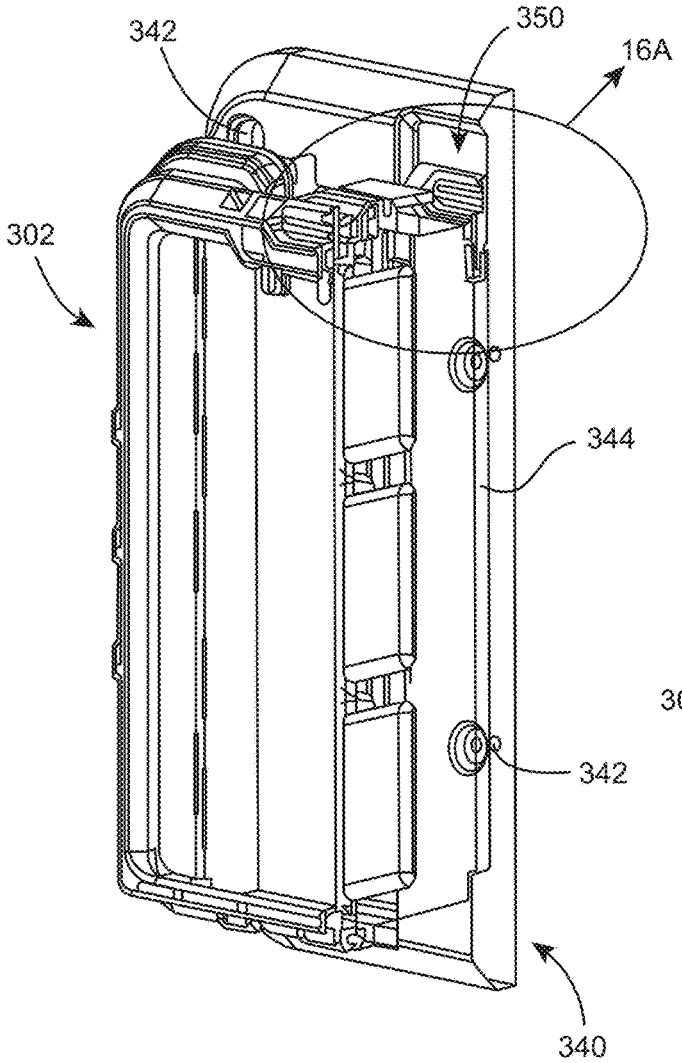
FIG. 15A is a sectioned view taken along line 15A-15A in FIG. 14B.
Figure 15B:
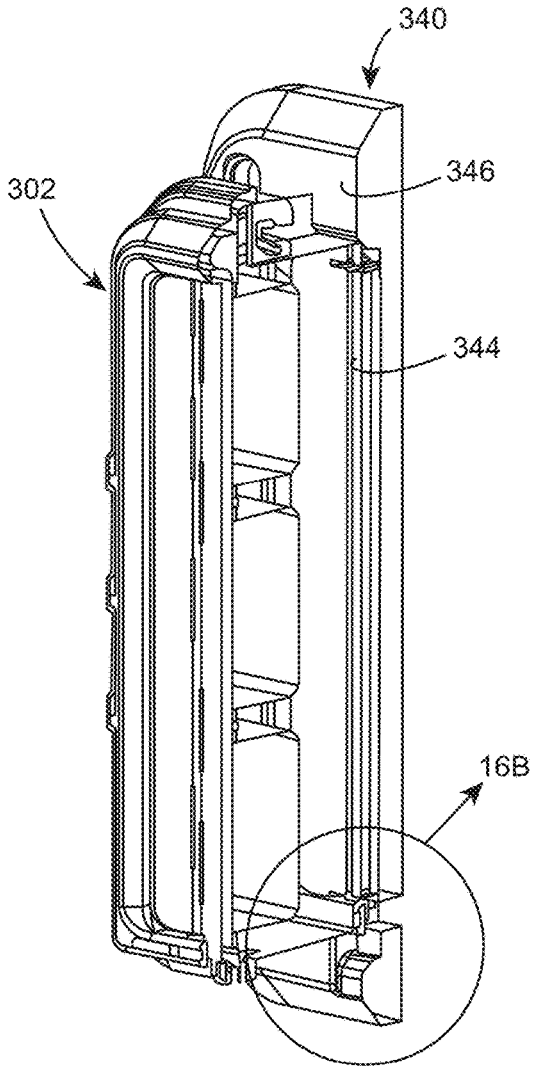
FIG. 15B is a sectioned view taken along line 15B-15B in FIG. 14B.
Figure 16B:
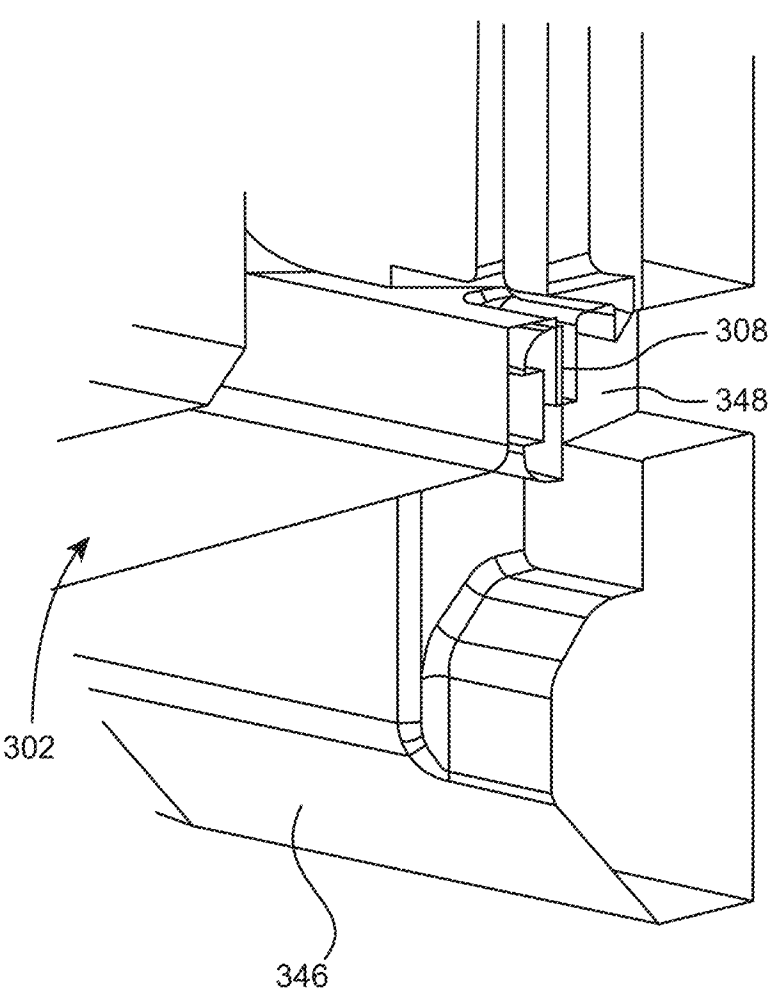
FIG. 16B is an enlargement of the portion marked 16B in FIG. 15B.
Figure 16A:
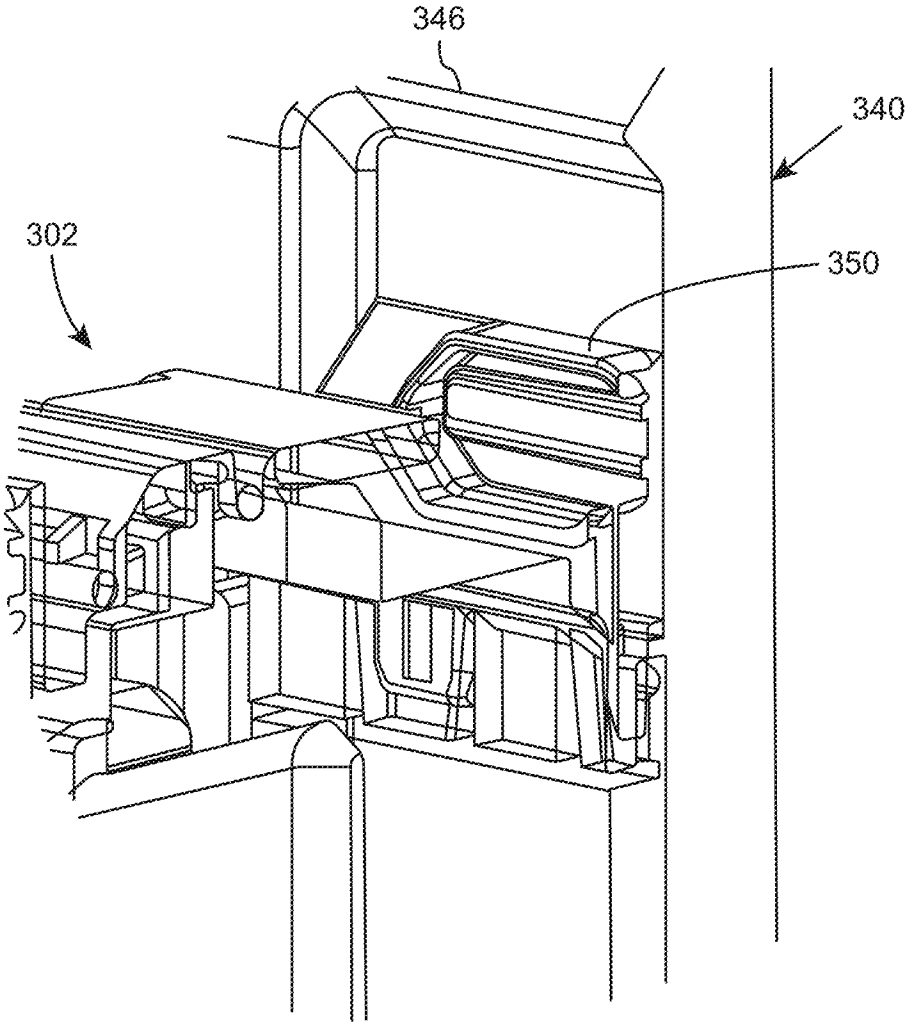
FIG. 16A is an enlargement of the portion marked 16A in FIG. 15A.

Still an example of a utility module, fitted with a connectivity arrangement according to as aspect of the disclosure is illustrated in FIG. 14A directed to a rigid mounting platform 340 being a rigid platform configured for attaching to a carrying surface such as a wall, a truck bed, or any other carrying structure (not shown), e.g. by fasteners extendable through openings 342.

A top face of the mounting platform 340 is configured with connectivity components of a second type utility module, i.e. a utility module arresting space 344 delimited by an annular rim 346, and configured with four tab arresting receptacles 348 at a first location (i.e. a rear face thereof, which at a vertical display of the of the mounting platform 340 is a bottom edge), and a pair of locking latches 350 disposed at an opposite, second location. The locking latches 350 are displaceable between a locked position, projecting into said utility module arresting space 344 and are engageable with a locking receptacle 310 in the container 302 (as in FIGS. 17A and 17B, being similar to the container articulated to the mounting platform 340), and an unlocked position, wherein said locking latches are retracted from said utility module arresting space 344.

Similar to the previous examples, the top face of the mounting platform 340 is configured with several longitudinal depressions 360 extending between elevated surfaces 362, over which a first utility module can easily slide into engagement, as described hereinbefore with reverence to earlier examples. Articulating and locking a so called 'first utility module', e.g. container 302, is facilitated in the same manner as described hereinbefore, namely by first engaging the engaging tabs 308 with the respective tab arresting receptacles 348, and upon positioning the rigid base 306 of container 302 over the arresting space 344 the locking latch 350 can be displaced into its locked position, projecting into the space 344 and into arresting engagement with the tab arresting receptacle 310 of the container 302.

When the mounting platform 340 is placed over a substantially horizontal surface there is no practical meaning to its positioning. However, when the mounting platform 340 is attached to a substantially vertical wall structure, it is practically advantageous that the mounting platform 340 be placed with the tab arresting receptacles 348 at a bottom location and the locking latches 350 above.

Figure 18:
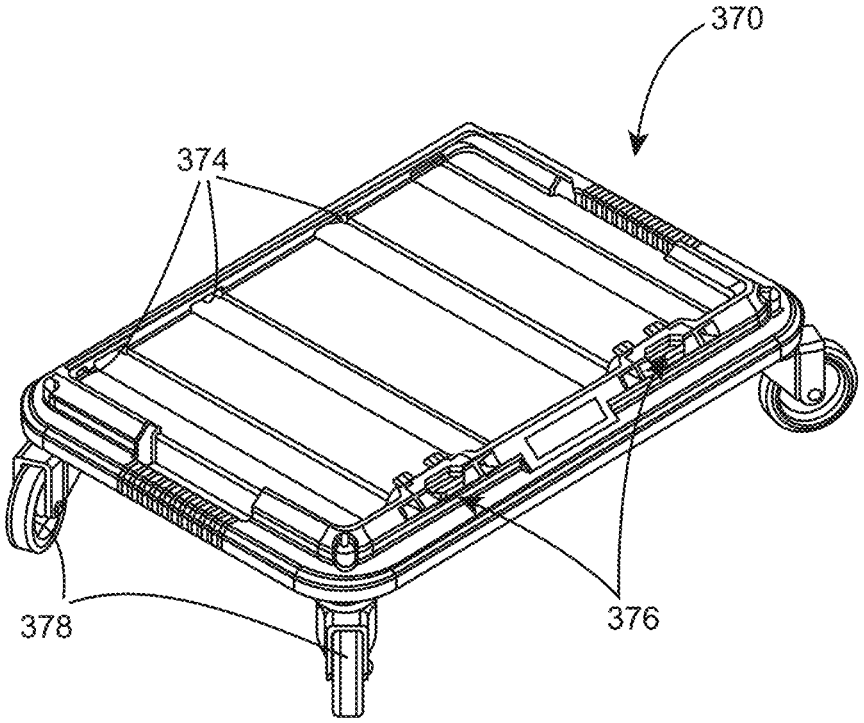
FIG. 18 is a top perspective view of still an example of a utility module, namely a dolly, configured with a connectivity system according to the disclosure.

Turning now to FIG. 18, there is illustrated a wheeled dolly generally designated 370. The dolly 370 is principally of same structure as mounting platform 340, however in addition to connectivity features (i.e. tab arresting receptacles 374 and locking latched 376) it is further configured for locomotion over caster wheels 378, and wherein articulating thereto and detaching therefrom, a so-called 'first utility module' takes place in the same manner as already explained hereinabove.

The invention claimed is:

1. A connectivity system for a utility module, comprising one or both of:

a rigid base portion with at least one engaging tab projecting at a first edge portion of the rigid base portion, and at least one locking receptacle disposed at a second edge portion of the rigid base portion, said at least one engaging tab and at least one locking receptacle extend substantially parallel to a surface of the rigid base portion, are disposed at opposite sides thereof, and face at an opposite sense; and a rigid mounting platform comprising an upwardly extending perimetric rim defining a utility module arresting space, the rim being configured with at least one tab arresting receptacle at a first location, and at least one locking latch at a second location; said at least one locking latch axially slidingly displaceable between a locked position wherein said at least one locking latch projects into said utility module arresting space and is engageable with a locking receptacle, and an unlocked position wherein said at least one locking latch is retracted from said utility module arresting space and a slanted fore tip of the at least one locking latch extending substantially flush with an inside surface of the rim.

2. The connectivity system according to claim 1, wherein the rigid base portion of a first utility module is configured to be applied over the rigid mounting platform of a second utility module, such that the rigid base portion at least partially bears over at least a portion of the rigid mounting platform, and wherein the first utility module is detachably articulated to the second utility module by arresting the at least one engaging tab with a corresponding at least one tab arresting receptacle, and displacing the at least one locking latch into the locked position, such that the at least one locking latch arrests within corresponding at least one locking receptacle.

3. The connectivity system according to claim 2, wherein (i) the at least one engaging tab and the at least one locking latch are disposed at opposite sides of the first utility module, or (ii) the at least one engaging tab is disposed at a rear side of the first utility module and the at least one locking latch is disposed at a front side of the first utility module.

4. The connectivity system according to claim 2, wherein the second utility module is configured with an upwardly extending perimetric rim, at least partially bordering the rigid mounting platform, wherein the utility module arresting space resides within the boundaries of the rim.

5. The connectivity system according to claims wherein (i) the rigid base portion of the first utility module is configured for at least partially nesting within the perimetric rim of the second utility module, (ii) the at least one tab arresting receptacle is configured as an opening at the perimetric rim, said opening facing an inside surface of the perimetric rim, and/or (iii) the opening of the at least one tab arresting receptacle is a through-going aperture at the perimetric rim.

6. The connectivity system according to claim 4, wherein at least portions of an inner wall of the perimetric rim are outwardly slanted, serving as a positioning aid in placing the rigid base portion of first utility module in register over the rigid mounting platform of the second utility module.

7. The connectivity system according to claim 2, wherein the length of the base portion, measured in the direction of a path of insertion is substantially similar, or slightly less, than the length of the arresting space of a second utility module, measured in the same direction, and wherein the length of the base portion of the first utility module including protruding length of the engaging tabs is greater than the length of the arresting space of the second utility module.

8. The connectivity system according to claim 1, wherein the first utility module is configured with a rigid base plate configured with an upright portion extending at a rear side, said upright portion comprising at least one rigid engaging tab laterally projecting therefrom, and at least one locking receptacle disposed at a front wall of the a rigid base plate, where said at least one engaging tab is engageable with corresponding at least one tab arresting receptacle disposed in register at an upwardly extending rear rim of a second utility module, and said at least one locking receptacle is configured for arresting engagement with a corresponding at least one locking latch at a front rim portion of the second utility module.

9. The connectivity system according to claim 1, wherein (i) the at least one engaging tab and at least one locking receptacle extend substantially parallel to one another, coaxial or offset, (ii) the at least one tab receptacle and at least one locking latch extend substantially parallel to one another, coaxial or offset, (iii) the at least one tab receptacle and at least one locking latch extend substantially normal to one another, (iv) the locking latch is axially displaceable between its respective locked position and unlocked position, (v) the locking latch is pivotally displaceable between its respective locked position and unlocked position, (vi) the locking latch is rotationally displaceable between its respective locked position and unlocked position, or (vii) the locking latch is manually displaceable at least between its unlocked position and its locked position.

10. The connectivity system according to claim 1, wherein the locking latch is configured with a tapering engaging surface, whereby applying a force vector over said engaging surface results in retraction displacement of the locking latch.

11. The connectivity system according to claim 1, wherein the one or more locking latch is normally biased into the locked position.

12. The connectivity system according to claim 1, wherein the locking latch is configured with a gripping portion for manipulating between the respective locked position and unlocked position, said gripping portion extending exterior to said utility module arresting space.

13. The connectivity system according to claim 12, wherein at a locked position of the locking latch, the gripping portion is received within a cutout portion at an exterior face of the perimetric rim of a second utility module.

14. The connectivity system according to claim 1, wherein (i) a bottom surface of the at least one tab arresting receptacle is flush with a bottom surface of the module arresting space at the rigid mounting platform, (ii) a bottom surface of the engaging tab is chamfered to facilitate easy insertion onto the corresponding tab arresting receptacle, (iii) a bottom surface of the at least one locking latch is displaceable coplanar with the bottom surface of the at least one tab arresting receptacle, or (iv) a bottom surface of the at least one locking latch is displaceable at a plane parallel with a plane of the bottom surface of the at least one tab arresting receptacle.

15. The connectivity system according to claim 1, wherein the rigid mounting platform is configured with depressions extending in direction between the at least one tab arresting receptacle and the at least one locking latch.

16. The connectivity system according to claim 1, wherein the at least one locking latch is spring biased into the locked position.

17. The connectivity system according to claim 1, wherein the at least one locking latch is displaceable between a distinct locked position and a distinct unlocked position, whereby the locking latch is prevented from spontaneous displacing between its respective positions by a snapping mechanism.

18. The connectivity system according to claim 1, wherein a bottom face of the rigid base portion is configured with one or more ridges extending from a bottom surface thereof, in direction between the first edge portion and the second edge portion, said one or more ridges being continuous or intermitted.

19. The connectivity system according to claim 1, wherein some or all side walls of the rigid base portion are inwardly inclined towards a bottom surface thereof, configured for easy positioning over a rigid mounting platform of another utility module.

20. The connectivity system according to claim 1, wherein a footprint of the rigid base portion is greater or smaller than the footprint of the rigid mounting platform.

21. The connectivity system according to claim 1, wherein the rigid mounting platform is a stand alone mounting arrangement configured for articulating thereto a utility module.

22. The connectivity system according to claim 1, wherein the rigid base portion of a first utility module is configured for at least partially engaging the utility module arresting space of the rigid mounting platform, or the rigid base portion of the first utility module is configured for at least partially bearing over at least a portion of the rigid mounting platform.

23. The connectivity system according to claim 1, wherein the rigid base portion is applied to a first utility module, and the rigid mounting platform is applied to a second utility module, and wherein the first utility module is articulable to the second utility module.

24. The connectivity system according to claim 23, wherein (i) at least one of the first utility module and the second utility module is a container, (ii) the rigid base portion is applied to a top portion of a container, or (iii) the rigid mounting platform is applied to a bottom portion of a container.

25. A utility module connectivity system comprising:

a first utility module configured with at least a rigid base portion with at least one engaging tab projecting at a first edge portion of the rigid base portion, and at least one locking receptacle disposed at a second edge portion of the rigid base portion;

said at least one engaging tab and at least one locking receptacle extend substantially parallel to a surface of the rigid base portion, are disposed at opposite sides thereof, and face at an opposite sense;

a second utility module comprising a rigid mounting platform comprising an upwardly extending perimetric rim defining a utility module arresting space, the rim being configured with at least one tab arresting receptacle at a first location, and at least one locking latch at a second location; said at least one locking latch axially slidingly displaceable between a locked position wherein said at least one locking latch projects into said utility module arresting space and is engageable with a locking receptacle of the first utility module, and an unlocked position wherein said at least one locking latch is retracted from said utility module arresting space and a slanted fore tip of the at least one locking latch extending substantially flush with an inside surface of the rim; and wherein the rigid base portion of the first utility module is configured for at least partially engaging the utility module arresting space of the rigid mounting platform.

26. A utility module system comprising two or more utility modules configured with a connectivity system for detachably coupling a utility module to another utility module, the connectivity system comprising:

a first utility module configured with at least a rigid base portion with at least one engaging tab projecting at a first edge portion of the rigid base portion, and at least one locking receptacle disposed at the rigid base portion;

said at least one engaging tab and at least one locking receptacle extend substantially parallel to a surface of the rigid base portion, are disposed at opposite sides thereof, and face at an opposite sense;

a second utility module comprising a rigid mounting platform comprising an upwardly extending perimetric rim defining a utility module arresting space, the rim being configured with at least one tab arresting receptacle at a first location and at least one locking latch at a second location; said at least one locking latch axially slidingly displaceable between a locked position wherein said at least one locking latch projects into said utility module arresting space and is engageable with a locking receptacle of the first utility module, and an unlocked position wherein said at least one locking latch is retracted from said utility module arresting space and a slanted fore tip of the at least one locking latch extending substantially flush with an inside surface of the rim; and wherein the rigid base portion of the first utility module is configured for at least partially engaging the utility module arresting space of the rigid mounting platform.

27. A utility module comprising a connectivity system, comprising:

at least a rigid base portion with at least one engaging tab projecting at a first edge portion of the rigid base portion, and at least one locking receptacle disposed at a second edge portion of the rigid base portion; said at least one engaging tab and at least one locking receptacle extend substantially parallel to a surface of the rigid base portion, are disposed at opposite sides thereof, and face at an opposite sense;

a rigid mounting platform comprising an upwardly extending perimetric rim defining a utility module arresting space, the rim being configured with at least one tab arresting receptacle at a first location, and at least one locking latch at a second location; said at least one locking latch axially slidingly displaceable between a locked position wherein said at least one locking latch projects into said utility module arresting space and is engageable with a locking receptacle of a first utility module, and an unlocked position wherein said at least one locking latch is retracted from said utility module arresting space and a slanted fore tip of the at least one locking latch extending substantially flush with an inside surface of the rim; and wherein the rigid base portion is configured for at least partially engaging the utility module arresting space of the rigid mounting platform.

* * * * *